US011615738B2

(12) United States Patent
Yue et al.

(10) Patent No.: US 11,615,738 B2
(45) Date of Patent: Mar. 28, 2023

(54) PIXEL DRIVING CIRCUIT AND DRIVING METHOD THEREFOR, DISPLAY PANEL, AND DISPLAY APPARATUS

(71) Applicant: BOE TECHNOLOGY GROUP CO., LTD., Beijing (CN)

(72) Inventors: Han Yue, Beijing (CN); Can Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 14 days.

(21) Appl. No.: 17/615,523

(22) PCT Filed: Oct. 22, 2020

(86) PCT No.: PCT/CN2020/122628
§ 371 (c)(1),
(2) Date: Nov. 30, 2021

(87) PCT Pub. No.: WO2021/083014
PCT Pub. Date: May 6, 2021

(65) Prior Publication Data

US 2022/0319401 A1 Oct. 6, 2022

(30) Foreign Application Priority Data

Oct. 30, 2019 (CN) ..... 201911046461.1

(51) Int. Cl.
*G09G 3/32* (2016.01)

(52) U.S. Cl.
CPC ..... *G09G 3/32* (2013.01); *G09G 2310/0262* (2013.01); *G09G 2310/0267* (2013.01); *G09G 2310/0275* (2013.01)

(58) Field of Classification Search
CPC ..... G09G 3/3233; G09G 2300/0861; G09G 3/3258; G09G 2320/045; G09G 2310/08; G09G 2300/0439; G09G 2320/0247; G09G 2310/0243; G09G 2310/0264; G09G 2310/06; G09G 3/2018
See application file for complete search history.

(56) References Cited

U.S. PATENT DOCUMENTS

| | | | | |
|---|---|---|---|---|
| 10,614,741 | B2 * | 4/2020 | Hashimoto | G09G 3/2014 |
| 11,373,586 | B2 * | 6/2022 | Jeong | G09G 3/32 |
| 2018/0293929 | A1 * | 10/2018 | Shigeta | G09G 3/3233 |

* cited by examiner

*Primary Examiner* — Duc Q Dinh
(74) *Attorney, Agent, or Firm* — IP & T Group LLP

(57) ABSTRACT

A pixel driving circuit includes a driving control sub-circuit having a first driving sub-circuit and a time control sub-circuit having a second driving sub-circuit. The driving control sub-circuit is configured to: be connected to an element to be driven, write a first data signal into the first driving sub-circuit, enable the first driving sub-circuit to output a driving signal to drive the element to operate. The time control sub-circuit is configured to: write a second voltage signal and a second data signal into the second driving sub-circuit, write a fourth voltage signal into the second driving sub-circuit, connect the second driving sub-circuit to a third voltage signal terminal and the first driving sub-circuit. The second driving sub-circuit is configured to output a third voltage signal to the first driving sub-circuit to enable the first driving sub-circuit to stop outputting the driving signal to control operating duration of the element.

20 Claims, 13 Drawing Sheets

PIXEL DRIVING CIRCUIT AND DRIVING METHOD THEREFOR, DISPLAY PANEL, AND DISPLAY APPARATUS

CROSS-REFERENCE TO RELATED APPLICATIONS

This application is a national phase entry under 35 USC 371 of International Patent Application No. PCT/CN2020/122628 filed on Oct. 22, 2020, which claims priority to Chinese Patent Application No. 201911046461.1, filed on Oct. 30, 2019, which are incorporated herein by reference in their entirety.

TECHNICAL FIELD

The present disclosure relates to the field of display technologies, and in particular, to a pixel driving circuit and a driving method therefor, a display panel and a display apparatus.

BACKGROUND

Self-luminous devices have received wide attention due to their high brightness and wide color gamut. However, due to uniformity problems in a manufacturing process, turn-on voltages of the self-luminous devices are not consistent, and photoelectric conversion properties (including photoelectric conversion efficiency, uniformity and chromaticity coordinates) of a self-luminous device will vary as a current flowing through the self-luminous device varies. For example, at a low current density, the luminous efficiency of the self-luminous device will decrease as the current density decreases, which results in high power consumption, and will affect a display effect of a display panel to a certain degree in a case where the self-luminous device is applied to the display panel.

SUMMARY

In first aspect, a pixel driving circuit is provided. The pixel driving circuit includes a driving control sub-circuit and a time control sub-circuit.

The driving control sub-circuit is connected to at least a first scan signal terminal, a first data signal terminal, a first voltage signal terminal, and an enable signal terminal. The driving control sub-circuit includes a first driving sub-circuit. The driving control sub-circuit is configured to: be connected to an element to be driven; write at least a first data signal from the first data signal terminal into the first driving sub-circuit, in response to a first scan signal received from the first scan signal terminal; and enable the first driving sub-circuit to output a driving signal according to the first data signal and a first voltage signal from the first voltage signal terminal, in response to an enable signal received from the enable signal terminal, so as to drive the element to be driven to operate.

The time control sub-circuit is connected to at least a second voltage signal terminal, a third voltage signal terminal, a fourth voltage signal terminal, a second scan signal terminal, a second data signal terminal, the enable signal terminal, and the first driving sub-circuit. The time control sub-circuit includes a second driving sub-circuit. The time control sub-circuit is configured to: write a second voltage signal from the second voltage signal terminal and a second data signal from the second data signal terminal into the second driving sub-circuit, in response to a second scan signal received from the second scan signal terminal; and write a fourth voltage signal that varies within a set voltage range from the fourth voltage signal terminal into the second driving sub-circuit, and connect the second driving sub-circuit to the third voltage signal terminal and the first driving sub-circuit, in response to the enable signal received from the enable signal terminal. The second driving sub-circuit is configured to output a third voltage signal from the third voltage signal terminal to the first driving sub-circuit, in response to the second voltage signal, the second data signal, and a variation in a voltage of the fourth voltage signal, so as to enable the first driving sub-circuit to stop outputting the driving signal to control an operating duration of the element to be driven.

In some embodiments, the first driving sub-circuit includes a driving transistor. The driving control sub-circuit is further connected to a first power voltage signal terminal. The driving control sub-circuit is further configured to: write a first power voltage signal from the first power voltage terminal into the first driving sub-circuit, and compensate for a threshold voltage of the driving transistor, in response to the first scan signal received from the first scan signal terminal; and write the first voltage signal into the first driving sub-circuit, in response to the enable signal received from the enable signal terminal, so that the driving signal is independent of the first power voltage signal and the threshold voltage of the driving transistor.

In some embodiments, the driving control sub-circuit further includes a first data writing sub-circuit and a first control sub-circuit. The first driving sub-circuit further includes a first capacitor. A first electrode of the first capacitor is connected to a first node, and a second electrode of the first capacitor is connected to a second node. A gate of the driving transistor is connected to the first node, and a first electrode of the driving transistor is connected to the first power voltage signal terminal.

The first data writing sub-circuit is connected to the first scan signal terminal, the first data signal terminal, a second electrode of the driving transistor, the first node, and the second node. The first data writing sub-circuit is configured to: write the first data signal into the second node, write the first power voltage signal into the first node, and compensate for the threshold voltage of the driving transistor, in response to the received first scan signal.

The first control sub-circuit is connected to the enable signal terminal, the first voltage signal terminal, the second node, the second electrode of the driving transistor. The first control sub-circuit is configured to: be connected to the element to be driven; and write the first voltage signal into the second node, and connect the driving transistor to the element to be driven, in response to the received enable signal.

In some embodiments, the first data writing sub-circuit includes a second transistor and a third transistor. A gate of the second transistor is connected to the first scan signal terminal, a first electrode of the second transistor is connected to the first data signal terminal, and a second electrode of the second transistor is connected to the second node. A gate of the third transistor is connected to the first scan signal terminal, a first electrode of the third transistor is connected to the second electrode of the driving transistor, and a second electrode of the third transistor is connected to the first node.

In some embodiments, the first control sub-circuit includes a fourth transistor and a fifth transistor. A gate of the fourth transistor is connected to the enable signal terminal, a first electrode of the fourth transistor is connected to the first voltage signal terminal, and a second electrode of the fourth transistor is connected to the second node. A gate of the fifth transistor is connected to the enable signal terminal, a first electrode of the fifth transistor is connected to the second electrode of the driving transistor, and a second electrode of the fifth transistor is configured to be connected to the element to be driven.

In some embodiments, the driving control sub-circuit further includes a first reset sub-circuit. The first reset sub-circuit is connected to a first initial signal terminal, a first reset signal terminal and the first node. The first reset sub-circuit is configured to transmit a first initial signal from the first initial signal terminal to the first node to reset the first node. in response to a first reset signal received from the first reset signal terminal.

In some embodiments, the first reset sub-circuit includes a sixth transistor. Agate of the sixth transistor is connected to the first reset signal terminal, a first electrode of the sixth transistor is connected to the first initial signal terminal, and a second electrode of the sixth transistor is connected to the first node.

In some embodiments, the time control sub-circuit further includes a second data writing sub-circuit and a second control sub-circuit. The second driving sub-circuit includes a first transistor and a second capacitor. A first electrode of the second capacitor is connected to a third node, and a second electrode of the second capacitor is connected to a fourth node. A gate of the first transistor is connected to the fourth node.

The second data writing sub-circuit is connected to the second scan signal terminal, the second data signal terminal, the second voltage signal terminal, the third node, the fourth node, and the first transistor. The second data writing sub-circuit is configured to: write the second data signal into the third node, write the second voltage signal into the fourth node, and compensate for a threshold voltage of the first transistor, in response to the received second scan signal.

The second control sub-circuit is connected to the enable signal terminal, the third voltage signal terminal, the fourth voltage signal terminal, the third node, the first transistor, and the first driving sub-circuit. The second control sub-circuit is configured to: write the fourth voltage signal into the third node, and connect the first transistor to the first driving sub-circuit and the third voltage signal terminal, in response to the received enable signal.

In some embodiments, the second data writing sub-circuit includes a seventh transistor, an eighth transistor, and a ninth transistor. A gate of the seventh transistor is connected to the second scan signal terminal, a first electrode of the seventh transistor is connected to the second data signal terminal, and a second electrode of the seventh transistor is connected to the third node. A gate of the eighth transistor is connected to the second scan signal terminal, a first electrode of the eighth transistor is connected to a first electrode of the first transistor, and a second electrode of the eighth transistor is connected to the fourth node. A gate of the ninth transistor is connected to the second scan signal terminal, a first electrode of the ninth transistor is connected to the second voltage signal terminal, and a second electrode of the ninth transistor is connected to a second electrode of the first transistor.

In some embodiments, the second control sub-circuit includes a tenth transistor, an eleventh transistor, and a twelfth transistor. A gate of the tenth transistor is connected to the enable signal terminal, a first electrode of the tenth transistor is connected to the fourth voltage signal terminal, and a second electrode of the tenth transistor is connected to the third node. A gate of the eleventh transistor is connected to the enable signal terminal, a first electrode of the eleventh transistor is connected to the third voltage signal terminal, and a second electrode of the eleventh transistor is connected to a second electrode of the first transistor. A gate of the twelfth transistor is connected to the enable signal terminal, a first electrode of the twelfth transistor is connected to a first electrode of the first transistor, and a second electrode of the twelfth transistor is connected to a gate of a driving transistor in the first driving sub-circuit.

In some embodiments, the time control sub-circuit further includes a second reset sub-circuit. The second reset sub-circuit is connected to a second initial signal terminal, a second reset signal terminal and the fourth node. The second reset sub-circuit is configured to transmit a second initial signal from the second initial signal terminal to the fourth node to reset the fourth node, in response to a second reset signal received from the second reset signal terminal.

In some embodiments, the second reset sub-circuit includes a thirteenth transistor. A gate of the thirteenth transistor is connected to the second reset signal terminal, a first electrode of the thirteenth transistor is connected to the second initial signal terminal, and a second electrode of the thirteenth transistor is connected to the fourth node.

In second aspect, a display panel is provided. The display panel includes a plurality of pixel driving circuits as described above and a plurality of elements to be driven. An element to be driven of the plurality of elements to be driven is connected to a corresponding pixel driving circuit.

In some embodiments, the display panel has a plurality of sub-pixel regions, and each pixel driving circuit is disposed in a sub-pixel region. The display panel further includes a plurality of first scan signal lines, a plurality of first data signal lines, a plurality of second scan signal lines, and a plurality of second data signal lines. First scan signal terminals connected to pixel driving circuits in a same row of sub-pixel regions are connected to a corresponding first scan signal line. Second scan signal terminals connected to the pixel driving circuits in the same row of sub-pixel regions are connected to a corresponding second scan signal line. First data signal terminals connected to pixel driving circuits in a same column of sub-pixel regions are connected to a corresponding first data signal line. Second data signal terminals connected to the pixel driving circuits in the same row of sub-pixel regions are connected to a corresponding second data signal line.

In some embodiments, the elements to be driven are current type light-emitting diodes.

In third aspect, a display apparatus is provided. The display apparatus includes the display panel as described above.

In fourth aspect, a driving method for a pixel driving circuit is provided, and the pixel driving circuit is as described above. A frame period includes a scanning phase and an operating phase, and the scanning phase includes a plurality of row scanning phases.

The driving method includes:

in each of the plurality of row scanning phases, writing, by the driving control sub-circuit, at least the first data signal from the first data signal terminal into the first driving sub-circuit, in response to the first scan signal received from the first scan signal terminal; and writing, by the time control sub-circuit, the second data signal from the second data signal terminal and the second voltage signal from the second voltage signal terminal into the second driving sub-circuit, in response to the second scan signal received from the second scan signal terminal; and in the operating phase, enabling, by the driving control sub-circuit, the first driving sub-circuit to output the driving signal according to the first data signal and the first voltage signal from the first voltage signal terminal, in response to the enable signal received from the enable signal terminal, so as to drive the element to be driven to operate;

writing, by the time control sub-circuit, the fourth voltage signal that varies within the set voltage range from the fourth voltage signal terminal into the second driving sub-circuit, and connecting, by the time control sub-circuit, the second driving sub-circuit to the third voltage signal terminal and the first driving sub-circuit, in response to the enable signal received from the enable signal terminal; and outputting, by the second driving sub-circuit, the third voltage signal from the third voltage signal terminal to the first driving sub-circuit, in response to the second voltage signal, the second data signal, and the variation in the voltage of the fourth voltage signal, so as to enable the first driving sub-circuit to stop outputting the driving signal to control the operating duration of the element to be driven.

In some embodiments, the first driving sub-circuit includes a driving transistor. The driving control sub-circuit is further connected to a first power voltage signal terminal.

The driving method further includes:

in each of the plurality of row scanning phases, writing, by the driving control sub-circuit, a first power voltage signal from the first power voltage signal terminal into the first driving sub-circuit, and compensating, by the driving control sub-circuit, for a threshold voltage of the driving transistor, further in response to the received first scan signal; and in the operating phase, writing, by the driving control sub-circuit, the first voltage signal into the first driving sub-circuit, further in response to the received enable signal.

In some embodiments, the first driving sub-circuit further includes a first capacitor. A first electrode of the first capacitor is connected to a first node, and a second electrode of the first capacitor is connected to a second node. A gate of the driving transistor is connected to the first node, and a first electrode of the driving transistor is connected to the first power voltage signal terminal. The driving control sub-circuit further includes a first data writing sub-circuit and a first control sub-circuit. The first data writing sub-circuit is connected to the first scan signal terminal, the first data signal terminal, a second electrode of the driving transistor, the first node, and the second node. The first control sub-circuit is connected to the enable signal terminal, the first voltage signal terminal, the second node, and the second electrode of the driving transistor. The first control sub-circuit is configured to be connected to the element to be driven.

In each of the plurality of row scanning phases, writing, by the driving control sub-circuit, at least the first data signal from the first data signal terminal into the first driving sub-circuit, in response to the first scan signal received from the first scan signal terminal; and in the operating phase, enabling, by the driving control sub-circuit, the first driving sub-circuit to output the driving signal according to the first data signal and the first voltage signal from the first voltage signal terminal, in response to the enable signal received from the enable signal terminal, so as to drive the element to be driven to operate, includes:

in each of the plurality of row scanning phases, writing, by the first data writing sub-circuit, the first data signal into the second node, writing, by the first data writing sub-circuit, the first power voltage signal into the first node, and compensating, by the first data writing sub-circuit, for the threshold voltage of the driving transistor, in response to the received first scan signal; and in the operating phase, writing, by the first control sub-circuit, the first voltage signal into the second node, and connecting, by the first data writing sub-circuit, the driving transistor to the element to be driven, in response to the received enable signal; and outputting, by the driving transistor, the driving signal according to the first data signal and the first voltage signal.

In some embodiments, the second driving sub-circuit includes a first transistor and a second capacitor. A first electrode of the second capacitor is connected to a third node, and a second electrode of the second capacitor is connected to a fourth node. A gate of the first transistor is connected to the fourth node. The time control sub-circuit further includes a second data writing sub-circuit and a second control sub-circuit. The second data writing sub-circuit is connected to the second scan signal terminal, the second data signal terminal, the second voltage signal terminal, the third node, the fourth node, and the first transistor. The second control sub-circuit is connected to the enable signal terminal, the third voltage signal terminal, the fourth voltage signal terminal, the third node, the first transistor, and the first driving sub-circuit.

In each of the plurality of row scanning phases, writing, by the time control sub-circuit, the second data signal from the second data signal terminal and the second voltage signal from the second voltage signal terminal into the second driving sub-circuit, in response to the second scan signal received from the second scan signal terminal; and in the operating phase, writing, by the time control sub-circuit, the fourth voltage signal that varies within the set voltage range from the fourth voltage signal terminal into the second driving sub-circuit, and connecting, by the time control sub-circuit, the second driving sub-circuit to the third voltage signal terminal and the first driving sub-circuit, in response to the enable signal received from the enable signal terminal, includes:

in each of the plurality of row scanning phases, writing, by the second data writing sub-circuit, the second data signal into the third node, writing, by the second data writing sub-circuit, the second voltage signal into the fourth node, and compensating, by the second data writing sub-circuit, for a threshold voltage of the first transistor, in response to the received second scan signal; and in the operating phase, writing, by the second control sub-circuit, the fourth voltage signal into the third node, and connecting, by the second control sub-circuit, the first transistor to the third voltage signal terminal and the first driving sub-circuit, in response to the received enable signal.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art can obtain other drawings according to these drawings. In addition, the accompanying drawings in the following description may be regarded as schematic diagrams, but are not limitations on actual sizes of products, actual processes of methods and actual timings of signals involved in the embodiments of the present disclosure.

DETAILED DESCRIPTION

Technical solutions in some embodiments of the present disclosure will be described clearly and completely below with reference to the accompanying drawings. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

In the description of some embodiments, the term "connected" and derivatives thereof may be used. For example, the term "connected" may be used in the description of some embodiments to indicate that two or more components are in direct physical contact or electrical contact with each other. However, terms such as "connected" may also mean that two or more components are not in direct contact with each other, but still cooperate or interact with each other. The embodiments disclosed herein are not necessarily limited to the content herein.

In circuits provided in the embodiments of the present disclosure, a first node, a second node, a third node, and a fourth node do not represent actual components, but represent junctions of related electrical connections in a circuit diagram. That is, these nodes are nodes equivalent to the junctions of related electrical connections in the circuit diagram.

In describing some embodiments, the term "configured to" as used herein has an open and inclusive meaning, which does not exclude devices configured to perform additional tasks or steps.

Figure 1:
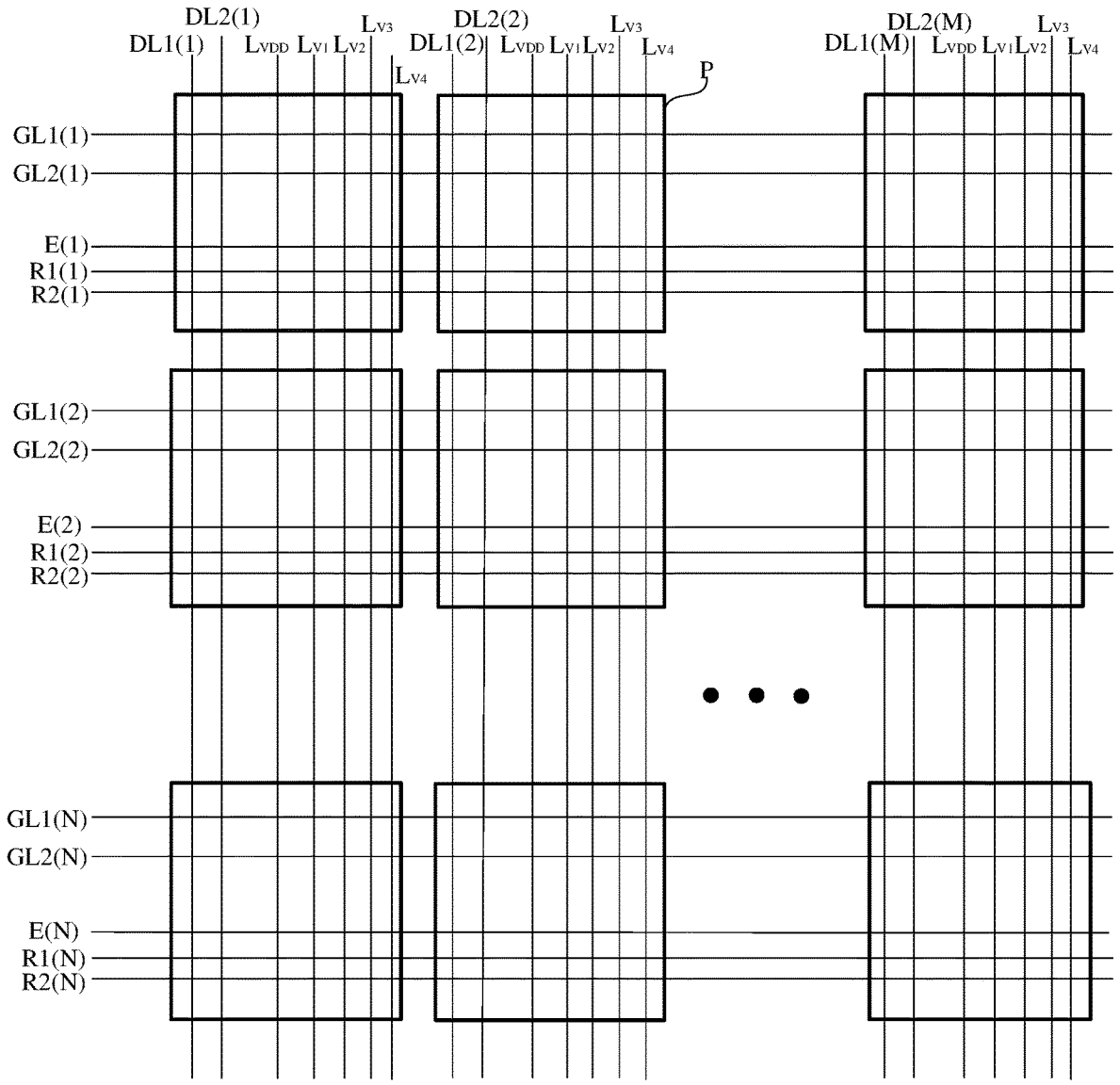
FIG. 1 is a structural diagram of a display panel, in accordance with some embodiments.
Figure 13:
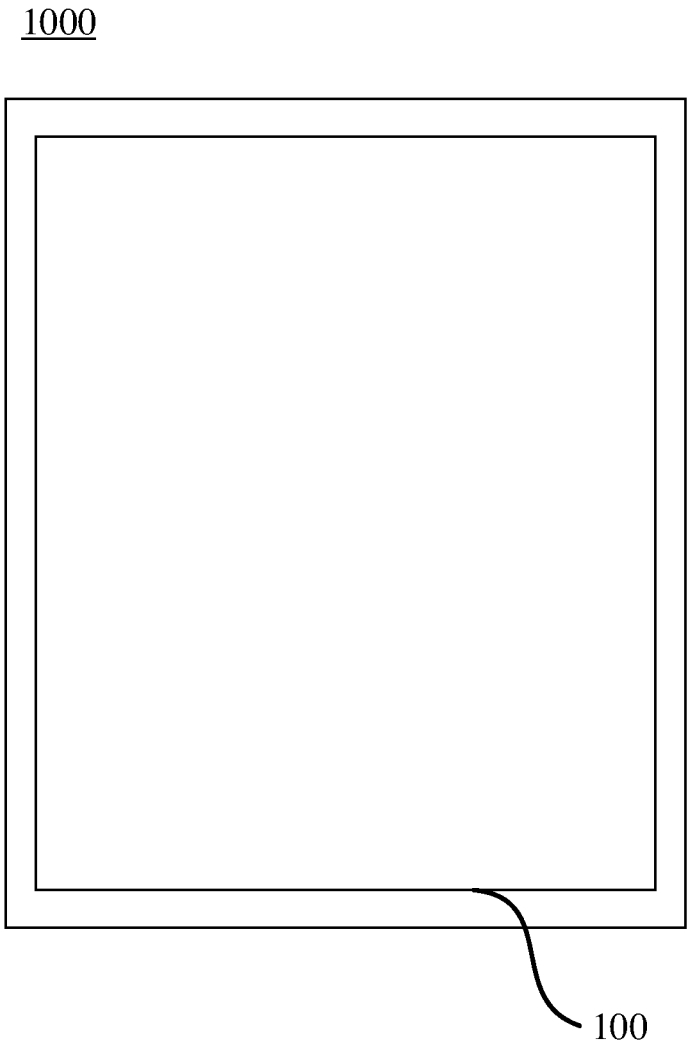
FIG. 13 is a structural diagram of a display apparatus, in accordance with some embodiments.

As shown in FIG. 13, some embodiments of the present disclosure provide a display apparatus 1000, which includes a display panel 100. As shown in FIG. 1, the display panel 100 has a plurality of sub-pixel regions P. It will be noted that, FIG. 1 illustrates an example in which the plurality of sub-pixel regions P are arranged in an array of N rows and M columns, but the embodiments of the present disclosure are not limited thereto, and the plurality of sub-pixel regions P may also be arranged in other manners.

In some embodiments, the display apparatus is a product having a display function such as a television, a cellphone, a tablet computer, a notebook computer, a display, a digital photo frame or a navigator, which is not limited in the embodiments of the present disclosure.

In some embodiments, the display panel includes a plurality of pixel driving circuits and a plurality of elements to be driven. An element to be driven of the plurality of elements to be driven is connected to a corresponding pixel driving circuit.

Figure 2:
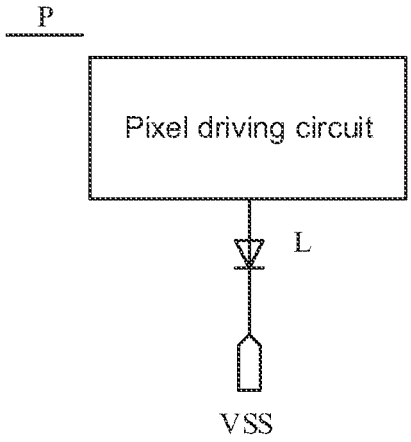
FIG. 2 is a structural diagram of a sub-pixel region P, in accordance with some embodiments.

In some examples, as shown in FIG. 2, a sub-pixel region P of the display panel is provided with an element L to be driven and a pixel driving circuit connected to a first electrode of the element L to be driven therein. The pixel driving circuit is configured to drive the element L to be driven to operate.

A second electrode of the element L to be driven is connected to a second power voltage signal terminal VSS.

In some embodiments, the element L to be driven is a current-driven device.

In some examples, the element L to be driven is a current type light-emitting diode.

For example, the current type light-emitting diode is a micro light-emitting diode (Micro LED), a mini light-emitting diode (Mini LED), or an organic light-emitting diode (OLED).

On this basis, an operation of the element L to be driven may be understood as that a current type light-emitting diode emits light.

In some examples, the first electrode and the second electrode of the element L to be driven are an anode and a cathode of the current type light-emitting diode, respectively.

Figure 3:
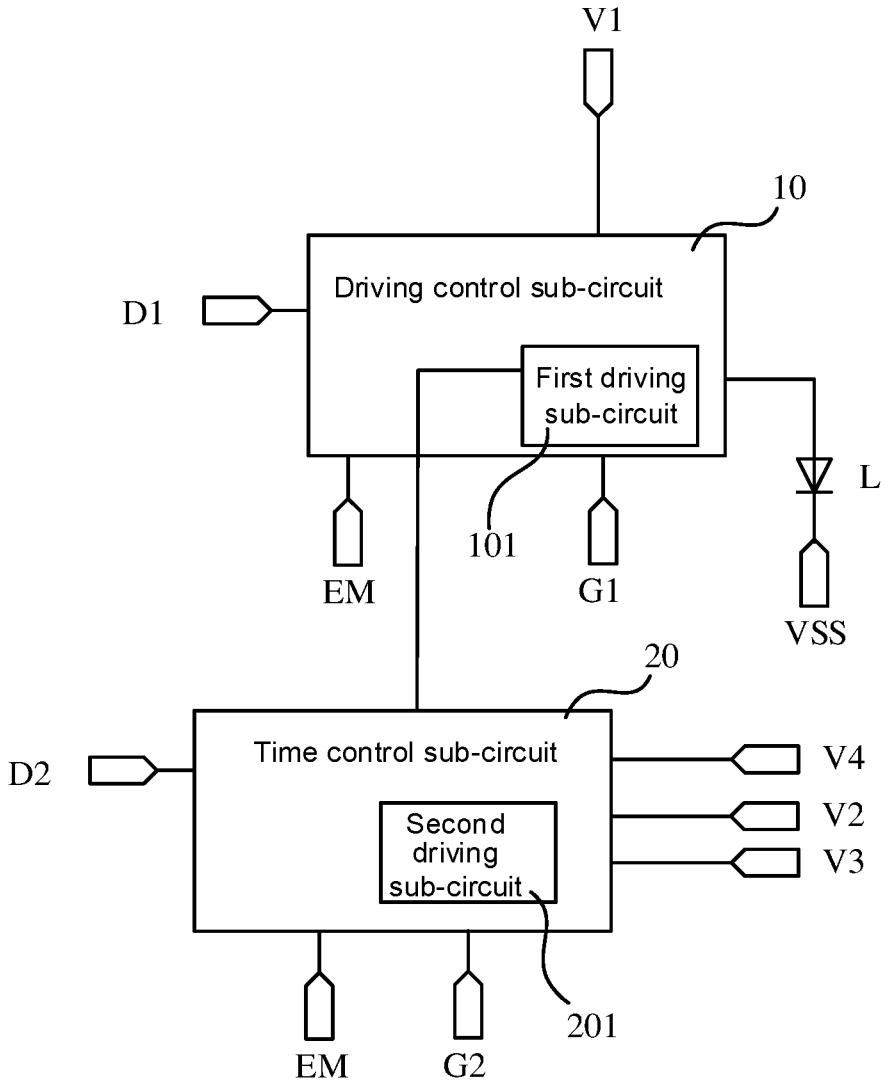
FIG. 3 is a structural block diagram of a pixel driving circuit, in accordance with some embodiments.

Some embodiments of the present disclosure provide a pixel driving circuit. As shown in FIG. 3, the pixel driving circuit includes a driving control sub-circuit 10 and a time control sub-circuit 20.

The driving control sub-circuit 10 is connected to at least a first scan signal terminal G1, a first data signal terminal D1, a first voltage signal terminal V1, an enable signal terminal EM, and an element L to be driven. The driving control sub-circuit 10 includes a first driving sub-circuit 101.

The driving control sub-circuit 10 is configured to: write at least a first data signal from the first data signal terminal D1 into the first driving sub-circuit 101, in response to a first scan signal received from the first scan signal terminal G1; and enable the first driving sub-circuit 101 to output a driving signal according to the first data signal from a first data signal terminal D1 and a first voltage signal from the first voltage signal terminal V1, in response to an enable signal received from the enable signal terminal EM, so as to drive the element to be driven to operate.

The time control sub-circuit 20 is connected to at least a second voltage signal terminal V2, a third voltage signal terminal V3, a fourth voltage signal terminal V4, a second scan signal terminal G2, a second data signal terminal D2, the enable signal terminal EM, and the first driving sub-circuit 101. The time control sub-circuit 20 includes a second driving sub-circuit 201.

The time control sub-circuit 20 is configured to: write a second voltage signal from the second voltage signal terminal V2 and a second data signal from the second data signal terminal D2 into the second driving sub-circuit 201, in response to a second scan signal received from the second scan signal terminal G2; and write a fourth voltage signal that varies within a set voltage range from the fourth voltage signal terminal V4 into the second driving sub-circuit 201, and connect the second driving sub-circuit 201 to the third voltage signal terminal V3 and the first driving sub-circuit 101, in response to the enable signal received from the enable signal terminal EM. The second driving sub-circuit 201 is configured to output a third voltage signal from the third voltage signal terminal V3 to the first driving sub-circuit 101, in response to the second voltage signal from the second voltage signal terminal V2, the second data signal from the second data signal terminal D2, and a variation in a voltage of the fourth voltage signal from the fourth voltage signal terminal V4, so as to enable the first driving sub-circuit 101 to stop outputting the driving signal to control an operating duration of the element L to be driven.

In some embodiments, outputting, by the driving control sub-circuit 10, the driving signal to drive the element L to be driven to operate, may be understood as that: outputting, by the driving control sub-circuit 10, a driving current to a current type light-emitting diode to drive the current type light-emitting diode to emit light. The operating duration of the element L to be driven may be understood as a luminous duration of the current type light-emitting diode.

In some examples, the first voltage signal from the first voltage signal terminal V1, the second voltage signal from the second voltage signal terminal V2, and the third voltage signal from the third voltage signal terminal V3 are all fixed voltage signals within a duration of a frame. Those skilled in the art may set voltage levels of the first voltage signal, the second voltage signal, and the third voltage signal on a premise of ensuring normal operation of the pixel driving circuit.

In some examples, the first data signal from the first data signal terminal D1 is a fixed high voltage signal, so that the element L to be driven may have a high luminous efficiency. In this case, the pixel driving circuit controls a gray scale through the time control sub-circuit 20.

In some other examples, a voltage of the first data signal from the first data signal terminal D1 varies within a certain voltage range, and the first data signal within the voltage range may ensure a high luminous efficiency of the element L to be driven. In this case, the pixel driving circuit controls the gray scale through both the driving control sub-circuit 10 and the time control sub-circuit 20.

In the driving control sub-circuit 10, by controlling voltage levels of the first data signal provided by the first data signal terminal D1 and the first voltage signal provided by the first voltage signal terminal V1, a magnitude of the driving signal (e.g., an amplitude of the driving current) transmitted from the driving control sub-circuit 10 to the element L to be driven is controlled. In the time control sub-circuit 20, by controlling voltage levels of the second data signal provided by the second data signal terminal D2, the second voltage signal provided by the second voltage signal terminal V2 and the fourth voltage signal provided by the fourth voltage signal terminal V4, a duration in which the third voltage signal provided by the third voltage signal terminal V3 is transmitted to the first driving sub-circuit 101 is controlled, so as to control a duration in which the driving signal is transmitted to the element L to be driven. Herein, when the third voltage signal is transmitted to the first driving sub-circuit 101, the first driving sub-circuit 101 stops outputting the driving signal, so that the driving control sub-circuit 10 cannot provide the driving signal to the element L to be driven, and the element L to be driven will not be driven to emit light. In this way, it may be possible to control the operating duration of the element L to be driven.

In the pixel driving circuit provided by some embodiments of the present disclosure, the driving control sub-circuit 10 writes at least the first data signal from the first data signal terminal D1 into the first driving sub-circuit 101, in response to the first scan signal received from the first scan signal terminal G1, and enables the first driving sub-circuit 101 to output the driving signal according to the first data signal from the first data signal terminal D1 and the first voltage signal from the first voltage signal terminal V1, in response to the enable signal received from the enable signal terminal EM, so as to drive the element L to be driven to operate. The time control sub-circuit 20 writes the second voltage signal from the second voltage signal terminal V2 and the second data signal from the second data signal terminal D2 into the second driving sub-circuit 201, in response to the second scan signal received from the second scan signal terminal G2, writes the fourth voltage signal that varies within the set voltage range from the fourth voltage signal terminal V4 into the second driving sub-circuit 201, and connects the second driving sub-circuit 201 to the third voltage signal terminal V3 and the first driving sub-circuit 101, in response to the enable signal received from the enable signal terminal EM. The second driving sub-circuit 201 outputs the third voltage signal from the third voltage signal terminal V3 to the first driving sub-circuit 101, in response to the second voltage signal, the second data signal and the variation in the voltage of the fourth voltage signal, so as to enable the first driving sub-circuit 101 to stop outputting the driving signal to control the operating duration of the element L to be driven. It will be seen that, the driving control sub-circuit 10 controls the magnitude of the driving signal transmitted to the element L to be driven, and the time control sub-circuit 20 controls the operating duration of the element L to be driven. In this way, when the element L to be driven performs display of different gray scales, by controlling the magnitude of the driving signal input to the element L to be driven and the luminous duration of the element L to be driven, it may be possible to vary the brightness of the element L to be driven, and thus achieve display of a corresponding gray scale. In a case where the element L to be driven is a current-driven type light-emitting device, when the element L to be driven performs display of a high gray scale, the pixel driving circuit outputs a large driving current to the element L to be driven, and may control the luminous duration of the element L to be driven to be a long luminous duration. When the element L to be driven performs display of a low gray scale, the driving current, output by the pixel driving circuit, to the element L to be driven may be a large current (e.g., a current corresponding to a certain high gray scale). By shortening the luminous duration of the element L to be driven, the brightness of the element L to be driven may be reduced. Alternatively, when the element L to be driven performs display of a low gray scale, the driving current, output by the pixel driving circuit, to the element L to be driven is maintained within a high value range (e.g., the driving current within the high value range is close to a current when a high gray scale is displayed). By shortening the luminous duration of the element L to be driven, the brightness of the element L to be driven may be reduced. Therefore, regardless of whether the element L to be driven performs display of a high gray scale or low gray scale, the driving current is always large, so that the element L to be driven is always at a high current density. As a result, the element L to be driven has a high luminous efficiency, stable brightness, lower power consumption, and good display effect.

Figure 4:
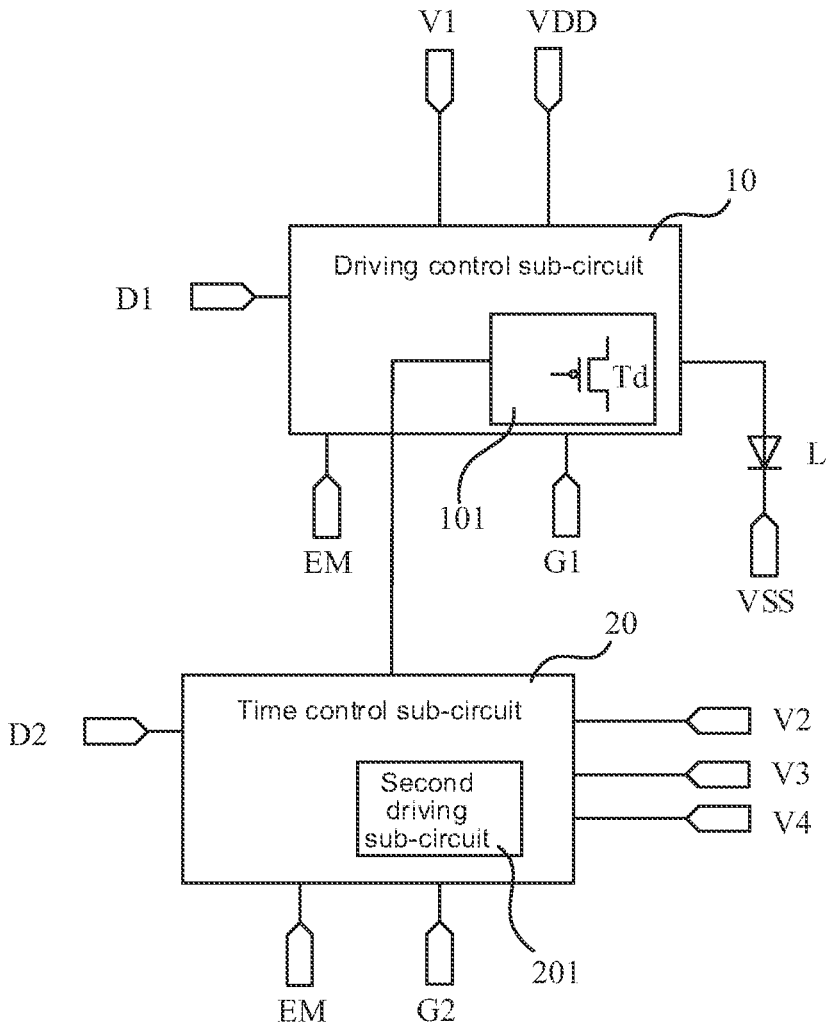
FIG. 4 is a structural block diagram of another pixel driving circuit, in accordance with some embodiments.

In some embodiments, as shown in FIG. 4, the first driving sub-circuit 101 includes a driving transistor Td. The driving control sub-circuit 10 is further connected to a first power voltage signal terminal VDD.

The driving control sub-circuit 10 is further configured to: write a first power voltage signal from the first power voltage terminal VDD into the first driving sub-circuit 101, and compensate for a threshold voltage of the driving transistor Td, in response to the first scan signal received from the first scan signal terminal G1; and write the first voltage signal from the first voltage signal terminal V1 into the first driving sub-circuit 101, in response to the enable signal received from the enable signal terminal EM, so that the driving signal is independent of the first power voltage signal and the threshold voltage of the driving transistor Td.

It will be seen that, by controlling the first data signal provided by the first data signal terminal D1 and the first voltage signal provided by the first voltage signal terminal V1, it may be possible to control the magnitude of the driving signal transmitted to the element L to be driven. On this basis, since the driving signal is independent of the first power voltage signal provided by the first power voltage signal terminal VDD and the threshold voltage of the driving transistor Td, it may be possible to prevent the threshold voltage of the driving transistor Td and a voltage drop of the first power voltage signal due to transmission from affecting the brightness of the element L to be driven, and thus improve the uniformity of brightness of the display panel.

Figure 5:
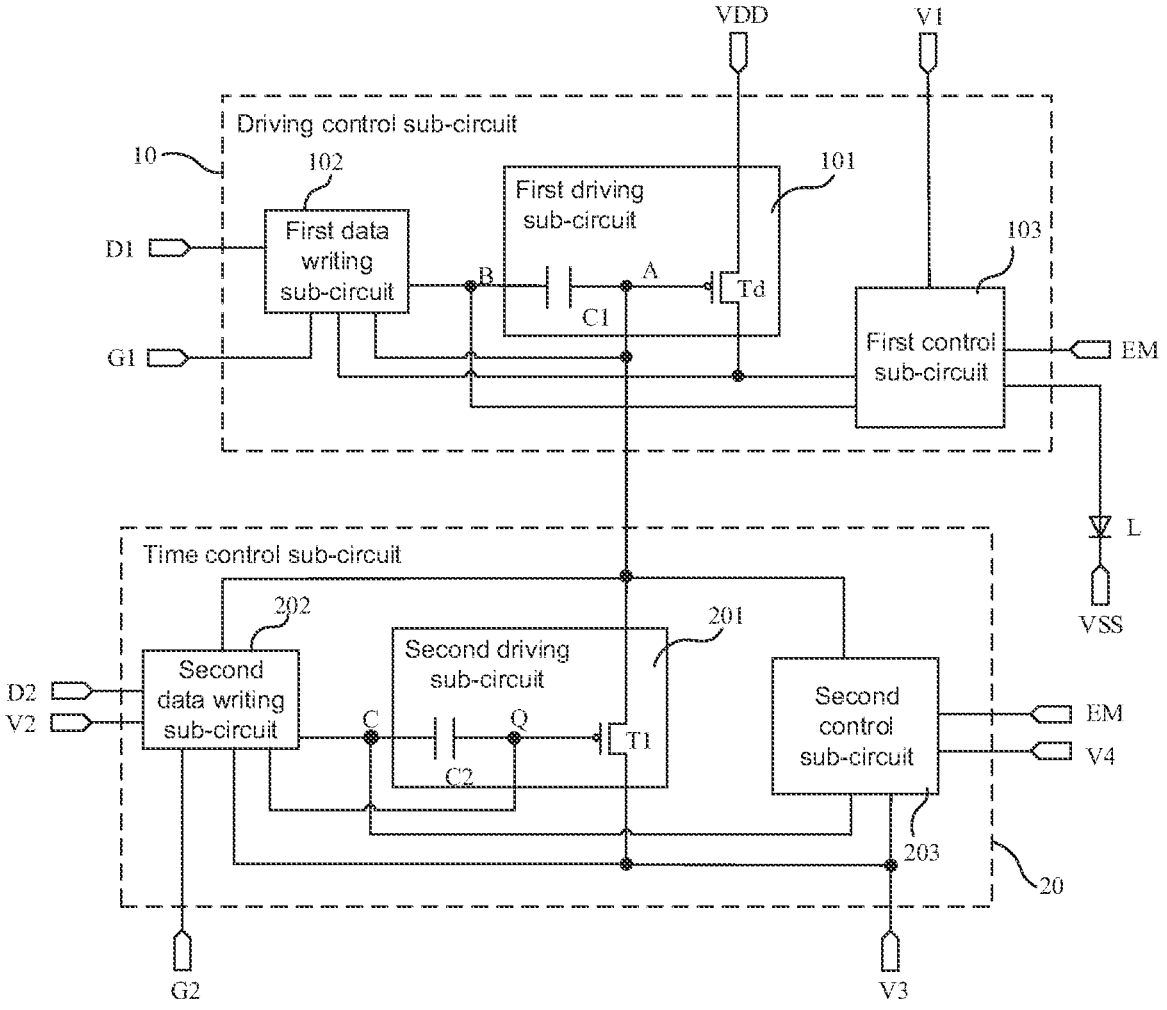
FIG. 5 is a structural block diagram of yet another pixel driving circuit, in accordance with some embodiments.

In some embodiments, as shown in FIG. 5, the driving control sub-circuit 10 includes the first driving sub-circuit 101, a first data writing sub-circuit 102 and a first control sub-circuit 103.

The first driving sub-circuit 101 includes the driving transistor Td and a first capacitor C1. A first electrode of the first capacitor C1 is connected to a first node A, and a second electrode of the first capacitor C1 is connected to a second node B. A gate of the driving transistor Td is connected to the first node A, and a first electrode of the driving transistor Td is connected to the first power voltage signal terminal VDD.

The first data writing sub-circuit 102 is connected to the first scan signal terminal G1, the first data signal terminal D1, a second electrode of the driving transistor Td, the first node A, and the second node B. The first data writing sub-circuit 102 is configured to: write the first data signal from the first data signal terminal D1 into the second node B, and write the first power voltage signal from the first power voltage signal terminal VDD and the threshold voltage of the driving transistor Td into the first node A to compensate for the threshold voltage of the driving transistor Td, in response to the first scan signal received from the first scan signal terminal G1.

The first control sub-circuit 103 is connected to the enable signal terminal EM, the first voltage signal terminal V1, the second node B, the second electrode of the driving transistor Td, and the element L to be driven. The first control sub-circuit 103 is configured to: write the first voltage signal from the first voltage signal terminal V1 into the second node B, and connect the driving transistor Td to the element L to be driven, in response to the enable signal received from the enable signal terminal EM. The driving transistor Td is configured to output the driving signal to drive the element L to be driven to emit light according to the first data signal provided by the first data signal terminal D1 and the first voltage signal provided by the first voltage signal terminal V1.

Figure 6:
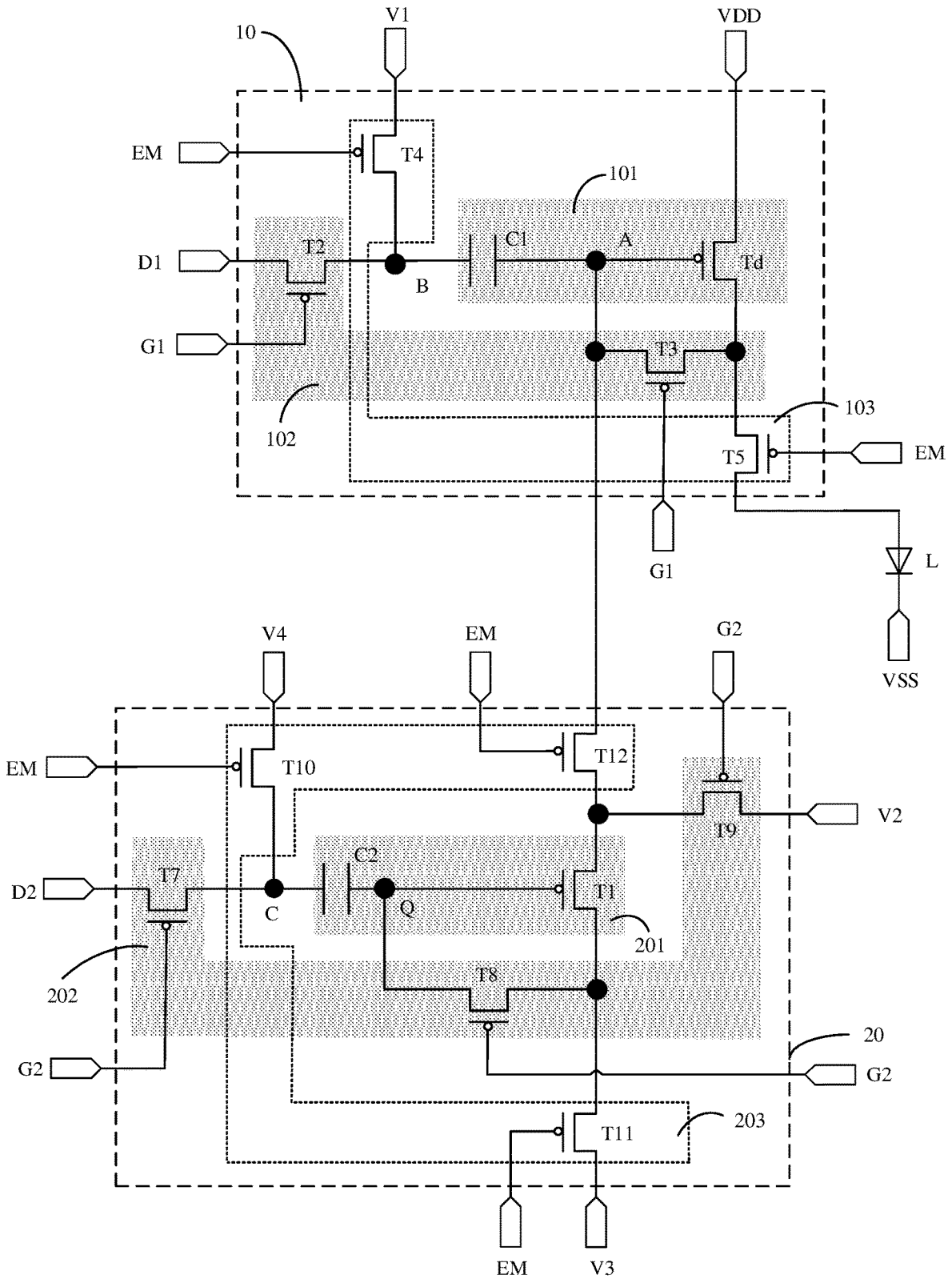
FIG. 6 is a circuit diagram of a pixel driving circuit, in accordance with some embodiments.

In some examples, as shown in FIG. 6, the first data writing sub-circuit 102 includes a second transistor T2 and a third transistor T3. A gate of the second transistor T2 is connected to the first scan signal terminal G1, a first electrode of the second transistor T2 is connected to the first data signal terminal D1, and a second electrode of the second transistor T2 is connected to the second node B. A gate of the third transistor T3 is connected to the first scan signal terminal G1, a first electrode of the third transistor T3 is connected to the second electrode of the driving transistor Td, and a second electrode of the third transistor T3 is connected to the first node A.

In some examples, as shown in FIG. 6, the first control sub-circuit 103 includes a fourth transistor T4 and a fifth transistor T5. A gate of the fourth transistor T4 is connected to the enable signal terminal EM, a first electrode of the fourth transistor T4 is connected to the first voltage signal terminal V1, and a second electrode of the fourth transistor T4 is connected to the second node B. A gate of the fifth transistor T5 is connected to the enable signal terminal EM, a first electrode of the fifth transistor T5 is connected to the second electrode of the driving transistor Td, and a second electrode of the fifth transistor T5 is connected to the element L to be driven.

Figure 7:
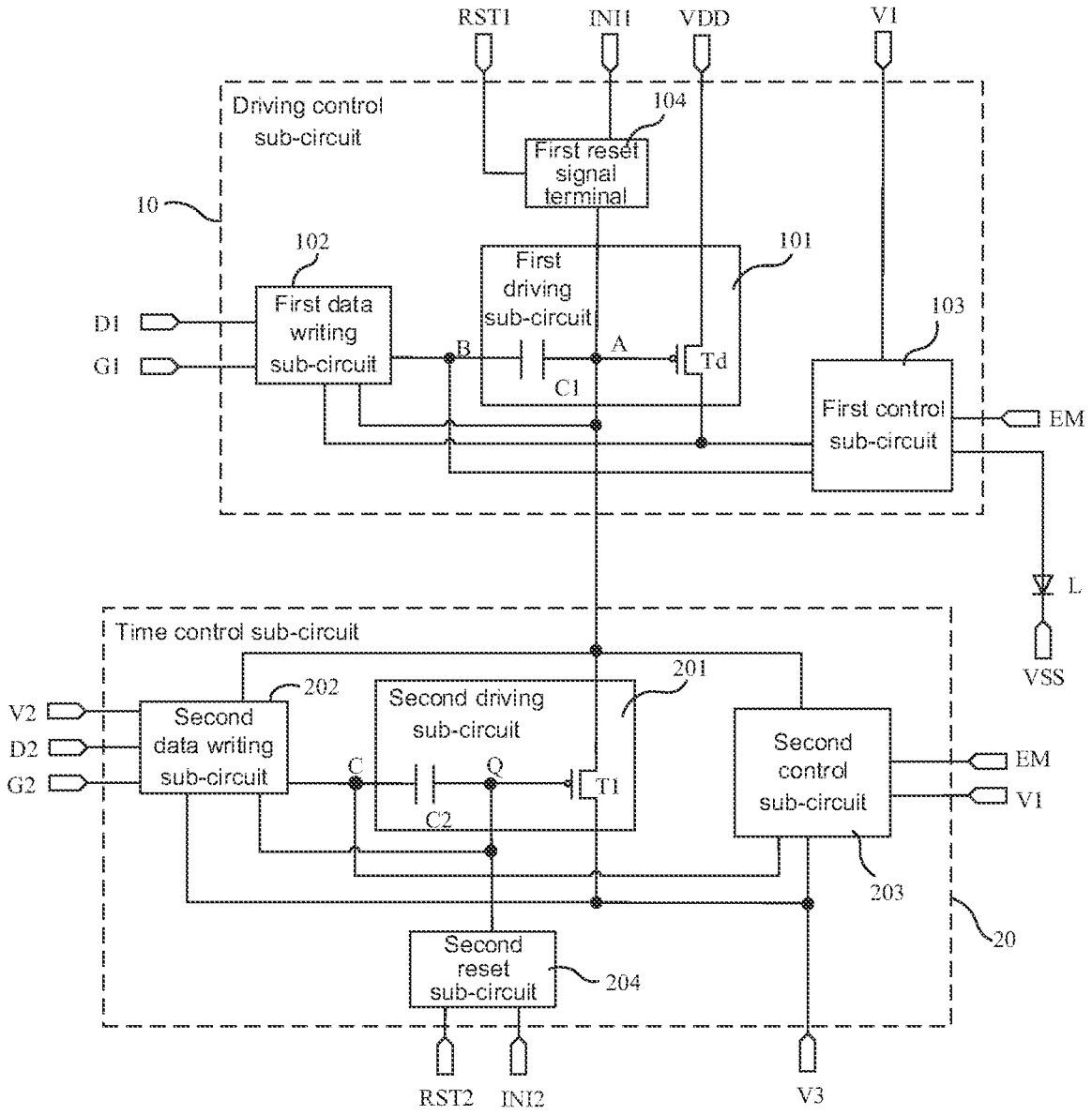
FIG. 7 is a structural block diagram of yet another pixel driving circuit, in accordance with some embodiments.

In some embodiments, as shown in FIG. 7, the driving control sub-circuit 10 further includes a first reset sub-circuit 104. The first reset sub-circuit 104 is connected to a first initial signal terminal INI1, a first reset signal terminal RST1 and the first node A. The first reset sub-circuit 104 is configured to transmit a first initial signal from the first initial signal terminal INI1 to the first node A to reset the first node A, in response to a first reset signal received from the first reset signal terminal RST1.

Figure 8:
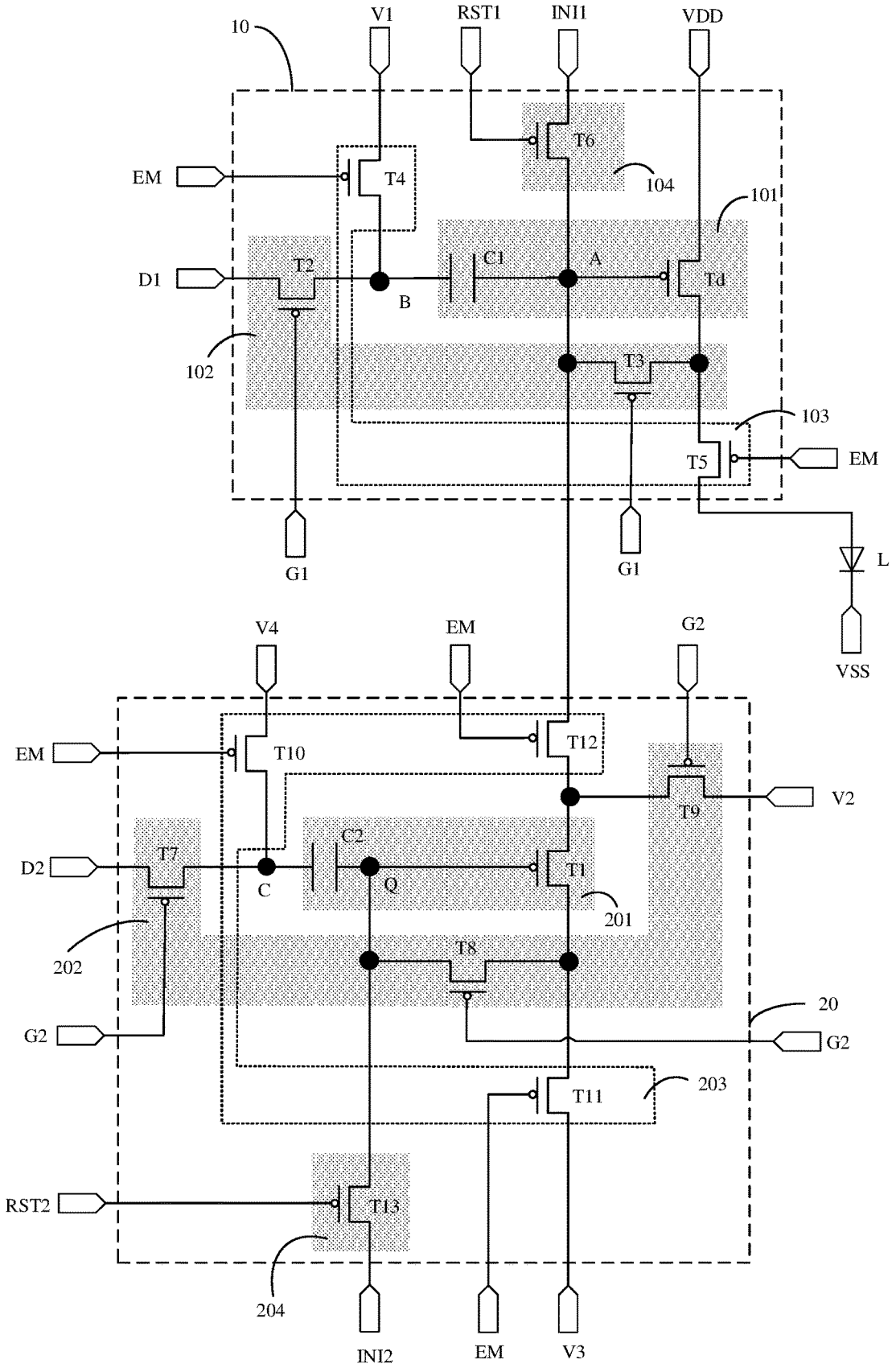
FIG. 8 is a circuit diagram of another pixel driving circuit, in accordance with some embodiments.

In some examples, as shown in FIG. 8, the first reset sub-circuit 104 includes a sixth transistor T6. A gate of the sixth transistor T6 is connected to the first reset signal terminal RST1, a first electrode of the sixth transistor T6 is connected to the first initial signal terminal INI1, and a second electrode of the sixth transistor T6 is connected to the first node A.

On this basis, since the first electrode of the first capacitor C1 and the gate of the driving transistor Td are both connected to the first node A, when the first node A is reset by the first reset sub-circuit 104, the first electrode of the first capacitor C1 and the gate of the driving transistor Td are both reset simultaneously, thereby achieving noise reduction of the first driving sub-circuit 101.

In some embodiments, as shown in FIG. 5, the time control sub-circuit 20 includes the second driving sub-circuit 201, a second data writing sub-circuit 202 and a second control sub-circuit 203. The second driving sub-circuit 201 includes a first transistor T1 and a second capacitor C2. A first electrode of the second capacitor C2 is connected to a third node C, and a second electrode of the second capacitor C2 is connected to a fourth node Q. A gate of the first transistor T1 is connected to the fourth node Q.

The second data writing sub-circuit 202 is connected to the second scan signal terminal G2, the second data signal terminal D2, the second voltage signal terminal V2, the third node C, the fourth node Q, and a first electrode and a second electrode of the first transistor T1. The second data writing sub-circuit 202 is configured to: write the second data signal from the second data signal terminal D2 into the third node C, and write the second voltage signal from the second voltage signal terminal V2 and a threshold voltage of the first transistor T1 into the fourth node Q to compensate for the threshold voltage of the first transistor T1, in response to the second scan signal received from the second scan signal terminal G2.

The second control sub-circuit 203 is connected to the enable signal terminal EM, the third voltage signal terminal V3, the fourth voltage signal terminal V4, the third node C, the first electrode and the second electrode of the first transistor T1, and the first driving sub-circuit 101. The second control sub-circuit 203 is configured to: write the fourth voltage signal that varies within the set voltage range from the fourth voltage signal terminal V4 into the third node C, and connect the first transistor T1 to the first driving sub-circuit 101 and the third voltage signal terminal V3, in response to the enable signal received from the enable signal terminal EM, so as to control the operating duration of the element L to be driven.

In a case where the first driving sub-circuit 101 includes the driving transistor Td, and the gate of the driving transistor Td is connected to the first node A, the second control sub-circuit 203 is connected to the first driving sub-circuit 101. That is, the second control sub-circuit 203 is connected to the first node. Correspondingly, the second control sub-circuit 203 is configured to connect the first transistor T1 to the first driving sub-circuit 101, in response to the received enable signal. That is, the second control sub-circuit 203 is configured to connect the first transistor T1 to the first node A, in response to the received enable signal.

The voltage of the fourth voltage signal varies over time within the set voltage range, and the set voltage range is determined according to the luminous duration of the element L to be driven. Therefore, by changing the voltage of the fourth voltage signal that varies within the set voltage range, it may be possible to control the luminous duration of the element L to be driven, and thus achieve control of the gray scale.

In the time control sub-circuit 20 provided by some embodiments of the present disclosure, the second data writing sub-circuit 202 writes the second data signal from the second data signal terminal D2 into the third node C, and writes the second voltage signal from the second voltage signal terminal V2 and the threshold voltage of the first transistor T1 into the fourth node Q, so that a voltage of the first electrode of the second capacitor C2 is a voltage (denoted as $V_{data2}$) of the second data signal, and a voltage of the second electrode of the second capacitor C2 is a sum of a voltage (denoted as $V_{V2}$) of the second voltage signal and the threshold voltage (denoted as $V_{th1}$) of the first transistor T1. On this basis, the second control sub-circuit 203 writes the fourth voltage signal that varies within the set voltage range from the fourth voltage signal terminal V4 into the third node C, so that a voltage of the third node C (i.e., the voltage of the first electrode of the second capacitor C2) varies from the voltage of the second data signal to a voltage (denoted as $V_{V4}$) of the fourth voltage signal. According to the law of charge retention of a capacitor, a voltage difference between the two electrodes of the second capacitor C2 remains unvaried. When the voltage of the third node C varies from $V_{data2}$ to $V_{V4}$, a voltage of the fourth node Q (i.e., the voltage of the second electrode of the second capacitor C2) varies as the voltage of the third node C varies. That is, the voltage of the fourth node Q becomes $V_{V2}+V_{th1}+(V_{V4}-V_{data2})$.

Since the voltage of the fourth voltage signal varies within the set voltage range, when the voltage of the fourth node Q varies to a certain value, the first transistor T1 is turned on. In this case, the first transistor T1 is connected to the gate of the driving transistor Td (i.e., the first node A) in the first driving sub-circuit 101 and the third voltage signal terminal V3, and the third voltage signal from the third voltage signal terminal V3 is transmitted to the gate of the driving transistor Td through the first transistor T1 to turn off the driving transistor Td. Since whether the first transistor T1 is turned on determines whether the driving signal is transmitted to the element L to be driven, by using the varying fourth voltage signal to control the first transistor T1 to be turned on or off, it may be possible to control the operating duration of the element L to be driven.

In some examples, as shown in FIG. 6, the second data writing sub-circuit 202 includes a seventh transistor T7, an eighth transistor T8, and a ninth transistor T9. A gate of the seventh transistor T7 is connected to the second scan signal terminal G2, a first electrode of the seventh transistor T7 is connected to the second data signal terminal D2, and a second electrode of the seventh transistor T7 is connected to the third node C. A gate of the eighth transistor T8 is connected to the second scan signal terminal G2, a first electrode of the eighth transistor T8 is connected to the first electrode of the first transistor T1, and a second electrode of the eighth transistor T8 is connected to the fourth node Q. A gate of the ninth transistor T9 is connected to the second scan signal terminal G2, a first electrode of the ninth transistor T9 is connected to the second voltage signal terminal V2, and a second electrode of the ninth transistor T9 is connected to the second electrode of the first transistor T1.

In some examples, as shown in FIG. 6, the second control sub-circuit 203 includes a tenth transistor T10, an eleventh transistor T11, and a twelfth transistor T12. A gate of the tenth transistor T10 is connected to the enable signal terminal EM, a first electrode of the tenth transistor T10 is connected to the fourth voltage signal terminal V4, and a second electrode of the tenth transistor T10 is connected to the third node C. A gate of the eleventh transistor T11 is connected to the enable signal terminal EM, a first electrode of the eleventh transistor T11 is connected to the third voltage signal terminal V3, and a second electrode of the eleventh transistor T11 is connected to the second electrode of the first transistor. A gate of the twelfth transistor T12 is connected to the enable signal terminal EM, a first electrode of the twelfth transistor T12 is connected to the first electrode of the first transistor T1, and a second electrode of the twelfth transistor T12 is connected to the gate of the driving transistor Td, i.e., connected to the first node A.

In some embodiments, as shown in FIG. 7, the time control sub-circuit 20 further includes a second reset sub-circuit 204. The second reset sub-circuit 204 is connected to a second initial signal terminal INI2, a second reset signal terminal RST2, and the fourth node Q. The second reset sub-circuit 204 is configured to transmit a second initial signal from the second initial signal terminal INI2 to the fourth node Q to reset the fourth node Q, in response to a second reset signal received from the second reset signal terminal RST2.

Since the second electrode of the second capacitor C2 and the gate of the first transistor T1 are both connected to the fourth node Q, when the second reset sub-circuit 204 resets the fourth node Q, the second electrode of the second capacitor C2 and the gate of the first transistor T1 are both reset simultaneously, thereby achieving noise reduction of the second driving sub-circuit 201.

In some examples, as shown in FIG. 8, the second reset sub-circuit 204 includes a thirteenth transistor T13. A gate of the thirteenth transistor T13 is connected to the second reset signal terminal RST2, a first electrode of the thirteenth transistor T13 is connected to the second initial signal terminal INI2, and a second electrode of the thirteenth transistor T13 is connected to the fourth node Q.

In the embodiments of the present disclosure, a first electrode is one of a source and a drain of a transistor, and a second electrode is the other of the source and the drain of the transistor. Since the source and the drain of the transistor may be symmetrical in structure, there may be no difference in structure between the source and the drain of the transistor. That is, there may be no difference in structure between the first electrode and the second electrode of the transistor in the embodiments of the present disclosure. For example, for a P-type transistor, a second electrode is referred to as a drain, and a first electrode is referred to as a source. For another example, for an N-type transistor, a first electrode is referred to as a drain, and a second electrode is referred to as a source.

In addition, depending on how a transistor conducts, transistors may be divided into enhancement-mode transistors and depletion-mode transistors. The transistors in the embodiments of the present disclosure may be enhancement-mode transistors or depletion-mode transistors, which is not limited thereto.

Figure 9:
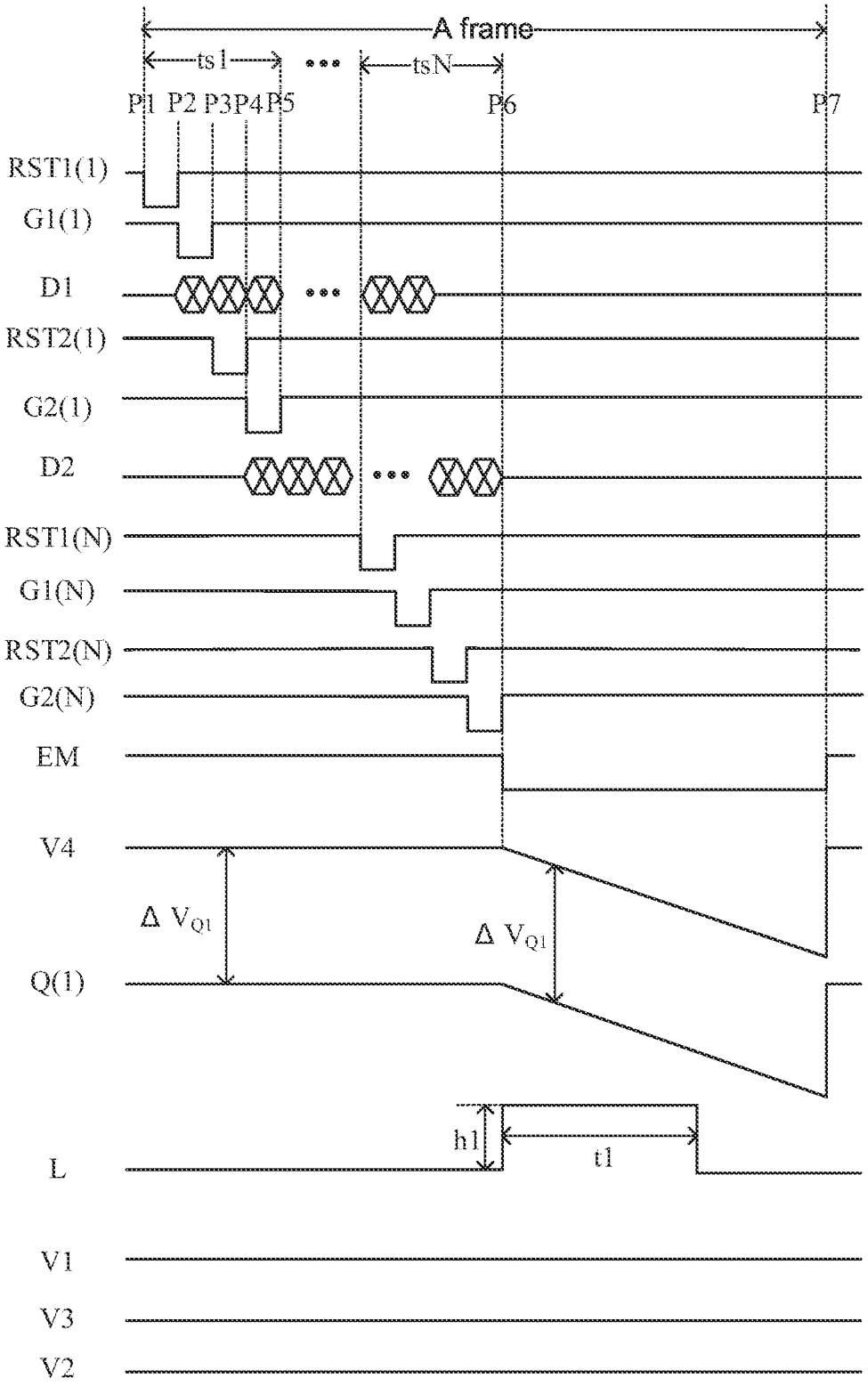
FIG. 9 is a signal timing diagram of a pixel driving circuit, in accordance with some embodiments.

On this basis, operations of the pixel driving circuit shown in FIG. 8 in different phases are illustrated by examples with reference to FIG. 9 (FIG. 9 is a signal timing diagram of the pixel driving circuit shown in FIG. 8). FIG. 8 illustrates an example where the transistors in the sub-circuits in the pixel driving circuits shown in FIG. 8 are all P-type transistors.

As shown in FIG. 9, a frame period includes a scanning phase (P1 to P6) and an operating phase (P6 to P7). The scanning phase (P1 to P6) includes a plurality of row scanning phases. In a case where the plurality of pixel driving circuits in the display panel are arranged in the sub-pixel regions P of N rows and M columns, the plurality of row scanning phases include N row scanning phases. The N row scanning phases are ts1 to tsN, where a first row scanning phase is ts1, an Nth row scanning phase is tsN, and N is an integer not less than 2.

In the scanning phase (P1 to P6), the pixel driving circuits in all rows of sub-pixel regions P are scanned row by row. That is, the pixel driving circuits are scanned row by row beginning from pixel driving circuits in the first row of sub-pixel regions P, and the first data signal and the second data signal are input to the pixel driving circuits in each row of sub-pixel regions P in sequence, until the first data signal and the second data signal are input to pixel driving circuits in the Nth row of sub-pixel regions P.

In some embodiments, after the pixel driving circuits in all rows of sub-pixel regions P are scanned row by row, the operating phase (P6 to P7) begins. In some examples, the pixel driving circuits in all rows of sub-pixel regions P may enter the operating phase in sequence. That is, the pixel driving circuits in the first row of sub-pixel regions P enter the operating phase first, and then pixel driving circuits in a second row of sub-pixel regions P enter the operating phase, until the pixel driving circuits in the Nth row of sub-pixel regions P enter the operating phase. An effective duration of the enable signal of the pixel driving circuits in each row of sub-pixel regions P in the operating phase is the same. In some other examples, the pixel driving circuits in all rows of sub-pixel regions P enter the operating phase synchronously.

In some other embodiments, the pixel driving circuits in each row of sub-pixel regions P enter the operating phase after a respective row scanning phase ends.

In each row scanning phase, pixel driving circuits in M sub-pixel regions located in a same row are synchronously written with the same or different first data signals. That is, the first data signal is a group of signals. The pixel driving circuits in the M sub-pixel regions located in the same row are synchronously written with the same or different second data signals. That is, the second data signal is a group of signals.

The following description will be made by taking an example where the pixel driving circuit is located in a first sub-pixel region P in the first row, and an element L to be driven connected to the pixel driving circuit is a current type light-emitting diode.

As shown in FIGS. 8 and 9, in the first row scanning phase ts1 in the scanning phase (P1 to P6), the pixel driving circuit in the first sub-pixel region P in the first row has the following driving process.

In a first phase (P1 to P2), in response to the first reset signal received from the first reset signal terminal RST1, the sixth transistor T6 is turned on and transmits the first initial signal from the first initial signal terminal INI1 to the first node A, so as to reset the first node A. In this case, a voltage of the first node A is a voltage (denoted as $V_{init1}$) of the first initial signal. In this case, the voltages of the first electrode of the first capacitor C1 and the gate of the driving transistor Td, which are both connected to the first node A, are also reset to $V_{init1}$.

The first initial signal provided by the first initial signal terminal INI1 may eliminate the influence of a signal of a previous frame on the first node A. In some examples, the first initial signal is a high-level signal. When the first reset sub-circuit 104 operates, the first initial signal resets the first node A and ensures that the driving transistor Td is in an off state.

In addition, the second reset signal from the second reset signal terminal RST2, the first scan signal from the first scan signal terminal G1, the enable signal from the enable signal terminal EM, and the second scan signal from the second scan signal terminal G2 are all high-level signals in the first phase (P1 to P2). Therefore, except for the sixth transistor T6, all other transistors are in an off state, and the element L to be driven does not operate.

In a second phase (P2 to P3), in response to the first scan signal received from the first scan signal terminal G1, the second transistor T2 is turned on and writes the first data signal from the first data signal terminal D1 into the second node B, so that a voltage of the second node B becomes a voltage (denoted as $V_{data1}$) of the first data signal. In this case, a voltage of the second electrode of the first capacitor C1 in the first driving sub-circuit 101 connected to the second node B is also $V_{data1}$.

In response to the first scan signal received from the first scan signal terminal G1, the third transistor T3 is turned on, so that the gate and the second electrode of the driving transistor Td are short-connected. In this way, the driving transistor Td is in a saturated state. A voltage of the gate of the driving transistor Td is a sum of a voltage of the first electrode thereof and the threshold voltage thereof. Since the first electrode of the driving transistor Td is connected to the first power voltage signal terminal VDD, the voltage of the first electrode of the driving transistor Td is the voltage (denoted as $V_{dd}$) of the first power voltage signal from the first power voltage signal terminal VDD. In this case, the voltage of the gate of the driving transistor Td is a sum of the voltage $V_{dd}$ of the first power voltage signal terminal VDD and the threshold voltage (denoted as $V_{thd}$) of the driving transistor Td, i.e., $V_{dd}+V_{thd}$. In this case, the voltage of the first node A connected to the gate of the driving transistor Td is also equal to $(V_{dd}+V_{thd})$.

In this case, the voltage of the first electrode of the first capacitor C1 connected to the first node A is equal to $(V_{dd}+V_{thd})$. The voltage of the second electrode of the first capacitor C1 is $V_{data1}$. The two electrodes of the first capacitor C1 are charged separately, and there is a voltage difference $V_{data1}-V_{dd}-V_{thd}$ between the two electrodes of the first capacitor C1.

The enable signal from the enable signal terminal EM is still the high-level signal in the second phase (P2 to P3), so that the fifth transistor T5 is in an off state. Therefore, the element L to be driven is disconnected from the driving transistor Td, and the element L to be driven does not operate. Of course, the fourth transistor T4 is also in an off state.

In addition, the first reset signal, the second reset signal, and the second scan signal are all high-level signals in the second phase (P2 to P3). Therefore, the sixth transistor T6 and all transistors in the time control sub-circuit 20 are all in an off state.

In a third phase (P3 to P4), in response to the second reset signal received from the second reset signal terminal RST2, the thirteenth transistor T13 is turned on, and transmits the second initial signal from the second initial signal terminal INI2 to the fourth node Q, so as to reset the fourth node Q. In this case, a voltage of the fourth node Q is a voltage (denoted as $V_{init2}$) of the second initial signal. In this case, the voltages of the second electrode of the second capacitor C2 and the gate of the first transistor T1, which are both connected to the fourth node Q, are also reset to $V_{init2}$.

The second initial signal provided by the second initial signal terminal INI2 may eliminate the influence of a signal of a previous frame on the fourth node Q. In some examples, the second initial signal is a high-level signal. When the second reset sub-circuit 204 operates, the fourth node Q is reset, and it is ensured that the first transistor T1 is in an off state.

In addition, the first reset signal, the first scan signal, the enable signal, and the second scan signal are all high-level signals in the third phase (P3 to P4). Therefore, the second transistor T2, the third transistor T3, the four transistor T4, the fifth transistor T5, the sixth transistor T6, the seventh transistor T7, the eighth transistor T8, the ninth transistor T9, the tenth transistor T10, the eleventh transistor T11, and the twelfth transistor T12 are all in an off state. In this case, the element L to be driven does not operate.

In a fourth phase (P4 to P5), in response to the second scan signal received from the second scan signal terminal G2, the seventh transistor T7 is turned on, and transmits the second data signal from the second data signal terminal D2 to the third node C, so that a voltage of the third node C is a voltage $V_{data2}$ of the second data signal. Since the first electrode of the second capacitor C2 is connected to the third node C, the voltage of the first electrode of the second capacitor C2 is $V_{data2}$.

In response to the second scan signal received from the second scan signal terminal G2, the eighth transistor T8 is turned on, so that the gate and the second electrode of the first transistor T1 are short-connected. In this way, the first transistor T1 is in a saturated state. The voltage of the gate of the first transistor T1 is the sum of the voltage of the first electrode thereof and the threshold voltage thereof.

Moreover, the ninth transistor T9 is turned on in response to the second scan signal received from the second scan signal terminal G2. Since the first electrode of the first transistor T1 is connected to the second electrode of the ninth transistor T9, when the ninth transistor T9 is turned on, the second voltage signal from the second voltage signal terminal V2 is transmitted to the first electrode of the first transistor T1. In this case, a voltage of the first electrode of the first transistor T1 is a voltage $V_{V2}$ of the second voltage signal from the second voltage signal terminal V2. In this case, the voltage of the gate of the first transistor T1 is a sum of the voltage $V_{V2}$ of the second voltage signal from the second voltage signal terminal V2 and the threshold voltage $V_{th1}$ of the first transistor T1, that is, $V_{V2}+V_{th1}$. Correspondingly, a voltage of the fourth node Q connected to the gate of the first transistor T1 is also equal to $(V_{V2}+V_{th1})$.

In this case, the voltage of the second electrode of the second capacitor C2 connected to the fourth node Q is also equal to $(V_{V2}+V_{th1})$. That is, the two electrodes of the second capacitor C2 are charged separately, and there is a voltage difference $V_{data2}-V_{V2}-V_{th1}$ between the two electrodes of the second capacitor C2.

Since the first reset signal, the second reset signal, the enable signal, and the first scan signal are all high-level signals in the fourth phase (P4 to P5), the second transistor T2, the third transistor T3, the fourth transistor T4, the fifth transistor T5, the sixth transistor T6, the tenth transistor T10, the eleventh transistor T11, the twelfth transistor T12, and the thirteenth transistor T13 are all in the off state. In this case, the element L to be driven does not operate.

It will be noted that, regardless of the possible signal interference between the signals, in some embodiments of the present disclosure, the first phase (P1 to P2) and the third phase (P3 to P4) may be carried out simultaneously. In some other embodiments, the second phase (P2 to P3) and the fourth phase (P4 to P5) may be carried out simultaneously.

After the first row scanning phase ts1 ends, the pixel driving circuits in the second row of sub-pixel regions P are scanned in a second row scanning phase ts2, until the pixel driving circuits in the Nth row of sub-pixel regions are scanned in the Nth row scanning phase tsN. As shown in FIG. 9, the pixel driving circuits in the sub-pixel regions from the second row to the Nth row are scanned row by row in a time period of P5 to P6 starting from an end moment (P5) of the first row scanning phase ts1.

Driving processes of the pixel driving circuits in the sub-pixel regions P from the second row to the Nth row in respective row scanning phases are the same as the driving process of the pixel driving circuits in the first row of sub-pixel regions P in the first row scanning phase ts1, and details will not be repeated here. That is, in the entire scanning phase (P1 to P6), the driving process from the first phase to the fourth phase needs to be performed N times.

In summary, in the entire scanning phase (P1 to P6), each of the N row scanning phases includes the first phase to the fourth phase, so that the first data signal and the second data signal may be written into the pixel driving circuits in the N rows of sub-pixel regions, and may be stored to prepare for the operating phase (P6 to P7).

In some examples, after the pixel driving circuits in the N rows of sub-pixel regions are scanned row by row, the pixel driving circuits in all rows of sub-pixel regions enter the operating phase (P6 to P7). In the operating phase (P6 to P7), the pixel driving circuit in the first sub-pixel region P of the first row has the following process.

Referring to FIGS. 8 and 9, in the driving control sub-circuit 10, the fourth transistor T4 and the fifth transistor T5 are turned on in response to the enable signal received from the enable signal terminal EM. The first voltage signal from the first voltage signal terminal V1 is transmitted to the second node B through the fourth transistor T4 that is turned on. In this case, the voltage of the second electrode of the first capacitor C1 is a voltage (denoted as $V_{V1}$) of the first voltage signal.

According to the law of charge retention of the capacitor, the voltage difference between the first electrode and the second electrode of the first capacitor C1 remains unvaried. Before the first voltage signal from the first voltage signal terminal V1 is transmitted to the second electrode of the first capacitor C1, the voltage difference between the second electrode and the first electrode of the first capacitor C1 is equal to $(V_{data1}-V_{dd}-V_{thd})$. Therefore, in the operating phase, when the voltage of the second electrode of the first capacitor C1 varies from the voltage $V_{data1}$ of the first data signal to the voltage $V_{V1}$ of the first voltage signal, the voltage of the first electrode of the first capacitor C1 is equal to $(V_{V1}-V_{data1}+V_{dd}+V_{thd})$. In this case, the voltage of the first node A and the voltage of the gate of the driving transistor Td are both equal to $(V_{V1}-V_{data1}+V_{dd}+V_{thd})$.

Since the voltage of the gate of the driving transistor Td is equal to $(V_{V1}-V_{data1}+V_{dd}+V_{thd})$, the first electrode of the driving transistor Td is the source, and the voltage of the source of the driving transistor Td is $V_{dd}$, the gate-source voltage difference $V_{gs}$ of the driving transistor T satisfies that: $V_{gs}=V_{V1}-V_{data1}+V_{dd}+V_{thd}-V_{dd}=V_{V1}-V_{data1}+V_{thd}$. In this case, the driving transistor Td is turned on when the gate-source voltage difference of the driving transistor Td is less than the threshold voltage thereof. That is, when $(V_{V1}-V_{data1}+V_{thd})<V_{thd}$, the driving transistor Td is turned on and outputs the driving current. The driving current is output from the second electrode of the driving transistor Td, and is transmitted to the element L to be driven through the fifth transistor T5 that is turned on, so as to drive the element L to be driven to operate.

The driving current I flowing through the driving transistor Td satisfies that: $I=K\times(V_{gs}-V_{thd})^2=K\times(V_{V1}-V_{data1}+V_{thd}-V_{thd})^2=K\times(V_{V1}-V_{data1})^2$. $K=\frac{1}{2}\times W/L\times C\times u$, where W/L is a width-to-length ratio of the driving transistor Td, C is a capacitance of a channel insulating layer, and u is a channel carrier mobility.

It will be seen that, the above parameters are only related to the structure of the driving transistor Td. Therefore, the driving current flowing through the driving transistor Td is only related to the voltage $V_{data1}$ of the first data signal from the first data signal terminal D1 and the voltage $V_{V1}$ of the first voltage signal from the first voltage signal terminal V1, and is neither related to the threshold voltage $V_{thd}$ of the driving transistor Td nor the first power voltage signal from the first power voltage signal terminal VDD.

On this basis, when the elements L to be driven in the sub-pixel regions P perform display of different gray scales, since a same first voltage signal may be input to the pixel driving circuits in the sub-pixel regions P, and the first voltage signal may be set to a fixed level signal, it may be possible to control the amplitude of the driving current flowing through the element L to be driven by controlling the first data signal.

Referring to FIGS. 8 and 9, in the time control sub-circuit 20, the tenth transistor T10, the eleventh transistor T11, and the twelfth transistor T12 are turned on in response to the enable signal received from the enable signal terminal EM. The fourth voltage signal that varies within the set voltage range from the fourth voltage signal terminal V4 is transmitted to the third node C through the tenth transistor T10 that is turned on, so that the voltage of the third node C becomes the voltage $V_{V4}$ of the fourth voltage signal. Since the first electrode of the second capacitor C2 is connected to the third node C, the voltage of the first electrode of the second capacitor C2 also becomes $V_{V4}$.

According to the law of charge retention of the capacitor, the voltage difference between the first electrode and the second electrode of the second capacitor C2 remains unvaried. Before the fourth voltage signal from the fourth voltage signal terminal V4 is transmitted to the first electrode of the second capacitor C2, the voltage difference between the first electrode and the second electrode of the second capacitor C2 is equal to $(V_{data2}-V_{V2}-V_{th1})$. Therefore, in the operating phase, when the voltage of the first electrode of the second capacitor C2 varies from the voltage $V_{data2}$ of the second data signal to the voltage $V_{V4}$ of the fourth voltage signal, the voltage of the second electrode of the second capacitor C2 is equal to $(V_{V4}-V_{data2}+V_{V2}+V_{th1})$. In this case, the voltage of the fourth node Q (i.e., the voltage of the gate of the first transistor T1) is also equal to $(V_{V4}-V_{data2}+V_{V2}+V_{th1})$.

Since the voltage $V_{V4}$ of the fourth voltage signal varies within the set voltage range, the voltage of the fourth node Q varies as the voltage $V_{V4}$ of the fourth voltage signal varies. It is assumed that, at a moment t, the voltage of the fourth voltage signal is $V_{V4}(t)$. At this time, the voltage of the fourth node Q satisfies that: $V_Q(t)=V_{V4}(t)-V_{data2}+V_{V2}+V_{th1}=V_{V4}(t)-\delta V_Q$, where $\delta V_Q=V_{data2}-V_{V2}-V_{th1}$. It can be seen that, the voltage $V_Q$ of the fourth node Q varies, by a variation amount $\delta V_Q$, as the voltage $V_{V4}$ of the fourth voltage signal varies, and a variation speed depends on the fourth voltage signal.

On this basis, since the voltage of the first electrode of the first transistor T1 is equal to the voltage (denoted as $V_A$) of the first node A, when the gate-source voltage difference (i.e., the voltage difference between the gate and the first electrode of the first transistor T1) of the first transistor T1 is less than the threshold voltage thereof, the first transistor T1 is turned on. That is, the gate-source voltage difference $V_{gs1}$ of the first transistor T1 satisfies that: $V_{gs1}=V_{V4}(t)-V_{data2}+V_{V2}+V_{th1}-V_A<V_{th1}$. It will be known that, whether the first transistor T1 is turned on is not related to the threshold voltage $V_{th1}$ thereof.

Since the second electrode of the first transistor T1 is connected to the second electrode of the eleventh transistor T11, when the eleventh transistor T11 is turned on, the second electrode of the first transistor T1 is connected to the third voltage signal terminal V3. The third voltage signal from the third voltage signal terminal V3 is transmitted to the second electrode of the first transistor T1 through the eleventh transistor T11 that is turned on, and is transmitted to the first node A through the first transistor T1 that is turned on. Since the gate of the driving transistor Td in the driving control circuit 10 is connected to the first node A, the third voltage signal from the third voltage signal terminal V3 is transmitted to the gate of the driving transistor Td. Since the third voltage signal is a high-level signal, the driving transistor Td is turned off. As a result, the driving current cannot be transmitted to the element L to be driven, and the element L to be driven does not operate. In this way, it may be possible to control the operating duration of the element L to be driven.

In addition, the way of controlling the operating duration of the element L to be driven is not related to a turn-on voltage of the element L to be driven itself. Therefore, it may be possible to avoid a Mura problem caused by uneven display brightness due to different turn-on voltages of the elements L to be driven in the display panel.

When the element L to be driven displays different gray scales, the voltage $V_{data2}$ of the second data signal provided by the second data signal terminal D2 may be controlled to be different, so that the variation amount $\Delta V_Q$ by which the voltage of the fourth node Q varies as the voltage $V_{V4}$ of the fourth voltage signal varies is also different. Therefore, due to the variation in the voltage of the fourth node Q, a duration in which the first transistor T1 is turned on is also different, and a duration in which the driving transistor Td is turned off is also different; as a result, a duration in which the driving current flows through the element L to be driven is different. In this way, in a case of a large (i.e., a high density) driving current, it may be possible to control the duration in which the driving current flows through the element L to be driven to make the element L to be driven display different gray scales. In this way, it may be possible to avoid a problem of low luminous efficiency and high power consumption of the element L to be driven when performing low gray scale display under a low current density.

Figure 10:
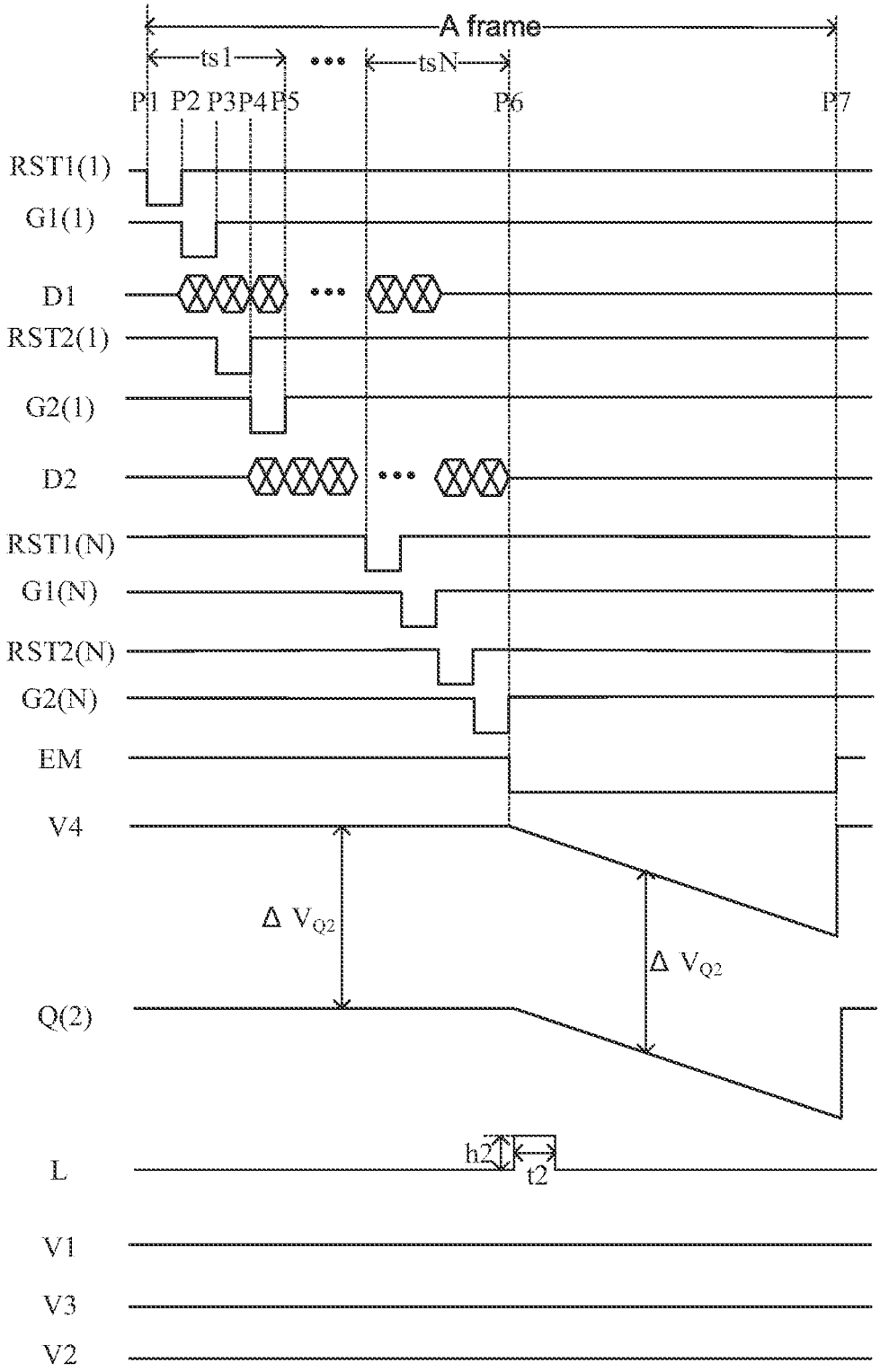
FIG. 10 is another signal timing diagram of a pixel driving circuit, in accordance with some embodiments.

FIGS. 9 and 10 are timing diagrams of the element L to be driven in a same sub-pixel region P when performing display of different gray scales. Q(1) in FIG. 9 represents a signal timing of the fourth node Q in a period of one image frame. The voltage of the fourth node Q is denoted as $V_{Q1}$, and $V_{Q1}$ varies as the voltage $V_{V4}$ of the fourth voltage signal varies by the variation amount $\Delta V_{Q1}$, i.e., $V_{Q1}=V_{V4}-\Delta V_{Q1}$. Q(2) in FIG. 10 represents a signal timing of the fourth node Q in a period of another image frame. The voltage of the fourth node Q is denoted as $V_{Q2}$, and $V_{Q2}$ varies as the voltage $V_{V4}$ of the fourth voltage signal varies by the variation amount $\Delta V_{Q2}$, i.e., $V_{Q2}=V_{V4}-\Delta V_{Q2}$. In the period of the one image frame and the period of the another image frame above, in a case where the voltages $V_{data2}$ of the second data signals from the second data signal terminal D2 are different, values of $\Delta V_{Q2}$ and $\Delta V_{Q1}$ are also different. Accordingly, the voltage of the fourth node Q is also different.

In this case, if the value of $\Delta V_{Q2}$ is greater than that of $\Delta V_{Q1}$, the duration in which the voltage $V_{Q2}$ of the fourth node Q varies to turn on the first transistor T1 is less than the duration in which the voltage $V_{Q1}$ of the fourth node Q varies to turn on the first transistor T1. Therefore, a duration t1 in which the driving current flows through the element L to be driven in the period of the one frame of image shown in FIG. 9 is greater than a duration t2 in which the driving current flows through the element L to be driven in the period of the another frame of image shown in FIG. 10. That is, the operating duration of the element L to be driven in the period of the one frame of image is greater than the operating duration of the element L to be driven in the period of the another frame of image. The element L to be driven in the one frame of image shown in FIG. 9 may achieve high gray scale display, and the element L to be driven in the another frame of image shown in FIG. 10 may achieve low gray scale display.

In some other examples, the voltage $V_{data1}$ of the first data signal provided by the first data signal terminal D1 is adjusted to control an amplitude of the driving current flowing through the element L to be driven, so that an amplitude h1 of the driving current flowing through the element L to be driven in the one frame of image shown in FIG. 9 is greater than an amplitude h2 of the driving current flowing through the element L to be driven in the another frame of image shown in FIG. 10. The element L to be driven in the one frame of image shown in FIG. 9 may achieve high gray scale display, and the element L to be driven in the another frame of image shown in FIG. 10 may achieve low gray scale display.

It will be noted that, as for the signal timing of the fourth node Q and how the element L to be driven emits light for pixel driving circuits in different sub-pixel regions P in a same frame of image, or pixel driving circuits in different sub-pixel regions P in different frames of image, reference may also be made to FIGS. 9 and 10, and details will not be repeated here.

Therefore, through joint action of the driving sub-circuit 10 and the time control sub-circuit 20 (that is, by using the driving control sub-circuit 10 to control the amplitude of the driving current flowing through the element L to be driven, and using the time control sub-circuit 20 to control the duration in which the driving current flows through the element L to be driven), it may be possible to enable the element L to be driven to realize display of different gray scales. Moreover, in a case where the amplitude of the driving current is maintained in a high value range, it may be possible to make the element L to be driven perform low gray scale display by shortening the operating duration of the element L to be driven, so as to improve the luminous efficiency of the element L to be driven, and avoid the problem of low luminous efficiency and high power consumption of the element L to be driven at a low current. In this way, the display effect of the display panel may be improved.

It will be noted that, as for the driving process of the pixel driving circuits in the sub-pixel regions P from the second row to the Nth row in the operating phase (P6 to P7), reference may be made to the description of the driving process of the pixel driving circuit in the sub-pixel region P in the first row in the operating phase (P6 to P7).

In summary, in a frame period, in the scanning phase (P1 to P6), the first data signal and the second data signal are written into each of the pixel driving circuits; and in the operating phase (P6 to P7), each pixel driving circuit outputs the driving current, and controls the duration in which the driving current is transmitted to the element L to be driven. In this way, it may be possible to control the brightness of the element L to be driven. On this basis, by controlling the amplitude of the driving current input to the element L to be driven and the luminous duration of the element L to be driven, it may be possible to vary the luminous intensity of the element L to be driven and thus achieve gray scale display. By increasing the driving current flowing through the element L to be driven and controlling the luminous duration of the element L to be driven to be a long luminous duration, it may be possible to achieve high gray scale display. By shortening the operating duration of the element L to be driven (i.e., by shortening the duration in which the large driving current flows through the element L to be driven), it may be possible to achieve low gray scale display. In this way, the element L to be driven may be able to operate in a stable current density range, and it may be possible to avoid a problem of unstable luminescence of the element L to be driven at a low current density, improve the luminous efficiency, and reduce the power consumption of the display panel.

Figure 11:
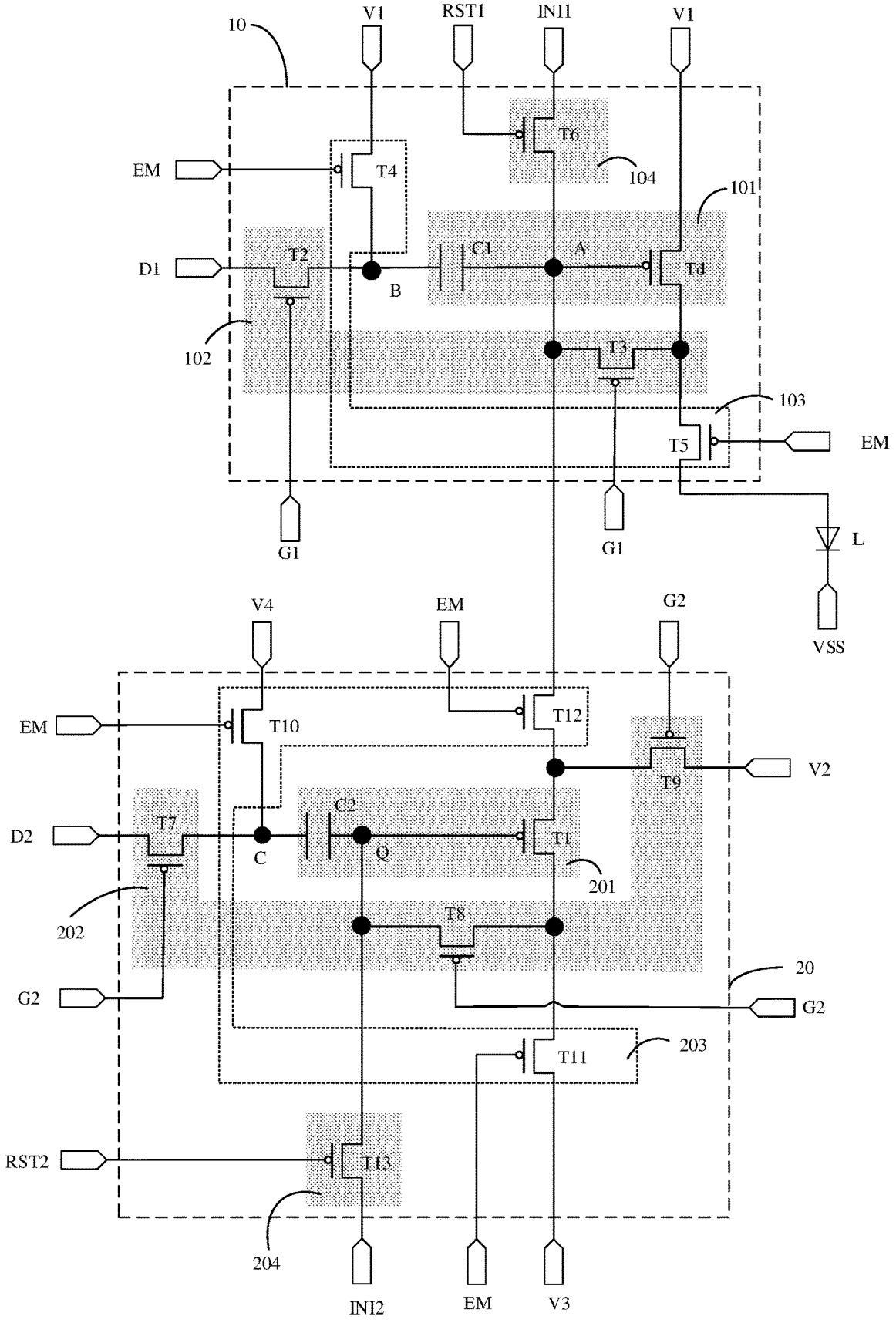
FIG. 11 is a circuit diagram of yet another pixel driving circuit, in accordance with some embodiments.

In some embodiments, the driving control sub-circuit 10 is connected to the first scan signal terminal G1, the first data signal terminal D1, the first voltage signal terminal V1, the enable signal terminal EM, and the element L to be driven. As shown in FIG. 11, the driving control sub-circuit 10 includes the first driving sub-circuit 101, the first data writing sub-circuit 102 and the first control sub-circuit 103. The first data writing sub-circuit 102 is connected to the first scan signal terminal G1, the first data signal terminal D1, the second electrode of the driving transistor Td, the first node A, and the second node B. The first control sub-circuit 103 is connected to the enable signal terminal EM, the first voltage signal terminal V1, the second node B, the second electrode of the driving transistor Td, and the element L to be driven. The first electrode of the driving transistor Td in the first driving sub-circuit 101 is connected to the first voltage signal terminal V1.

The driving process of the pixel driving circuit shown in FIG. 11 is described below by taking an example where all transistors in the pixel driving circuit shown in FIG. 11 are P-type transistors.

Referring to FIGS. 9 and 11, in the second phase (P2 to P3), the third transistor T3 and the second transistor T2 are turned on in response to the first scan signal from the first scan signal terminal G1. The first data signal from the first data signal terminal D1 is transmitted to the second node B through the second transistor T2 that is turned on, so that the voltage of the second node B becomes the voltage $V_{data1}$ of the first data signal. The voltage of the second electrode of the first capacitor C1, in the first driving sub-circuit 101, connected to the second node B also becomes $V_{data1}$.

The third transistor T3 is turned on, so that the gate and the second electrode of the driving transistor Td are short connected. In this way, the driving transistor Td is in a saturated state, and the voltage of the gate of the driving transistor Td is the sum of the voltage of the first electrode thereof and the threshold voltage thereof. Since the first electrode of the driving transistor Td is connected to the first voltage signal terminal V1, the voltage of the first electrode of the driving transistor Td is the voltage $V_{V1}$ of the first voltage signal from the first voltage signal terminal V1. In this case, the voltage of the gate of the driving transistor Td is the sum of the voltage $V_{V1}$ of the first voltage signal terminal V1 and the threshold voltage $V_{thd}$ of the driving transistor Td, i.e., $V_{V1}+V_{thd}$. The voltage of the first node A connected to the gate of the driving transistor Td is also equal to $(V_{V1}+V_{thd})$.

The voltage of the first electrode of the first capacitor C1 connected to the first node A is equal to $(V_{V1}+V_{thd})$, and the voltage of the second electrode of the first capacitor C1 is $V_{data1}$; the two electrodes of the first capacitor C1 are charged separately, and there is a voltage difference $V_{data1}-V_{V1}-V_{thd}$ between the two electrodes of the first capacitor C1.

In the operating phase, the fourth transistor T4 and the fifth transistor T5 are turned on in response to the enable signal from the enable signal terminal EM. The fourth transistor T4 is turned on and transmits the first voltage signal to the second node B, so that the voltage of the second node B varies from the voltage $V_{data1}$ of the first data signal to the voltage $V_{V1}$ of the first voltage signal. In this case, the voltage of the gate of the driving transistor Td is equal to $(V_{V1}-V_{data1}+V_{V1}+V_{thd})$, and the voltage of the source of the driving transistor Td is the voltage $V_{V1}$ of the first voltage signal; and the gate-source voltage $V_{gs}$ of the driving transistor Td satisfies that: $V_{gs}=V_{V1}-V_{data1}+V_{V1}+V_{thd}-V_{V1}=V_{V1}-V_{data1}+V_{thd}$. Therefore, the driving current I flowing through the driving transistor Td satisfies that: $I=K\times(V_{V1}-V_{data1})^2$. In this way, it may also be possible to compensate for the threshold voltage of the driving transistor Td, and eliminate the influence of the threshold voltage of the driving transistor Td on the driving current. Moreover, the voltage $V_{data1}$ of the first data signal may also be controlled to control the amplitude of the driving current flowing through the driving transistor Td.

It will be noted that, the driving process of the first reset sub-circuit 104 and the time control sub-circuit 20 in the pixel driving circuit shown in FIG. 11 is the same as the driving process of the first reset sub-circuit 104 and the time control sub-circuit 20 in any one of the above embodiments, and both have the same beneficial effects. Details will not be repeated here.

Figure 12:
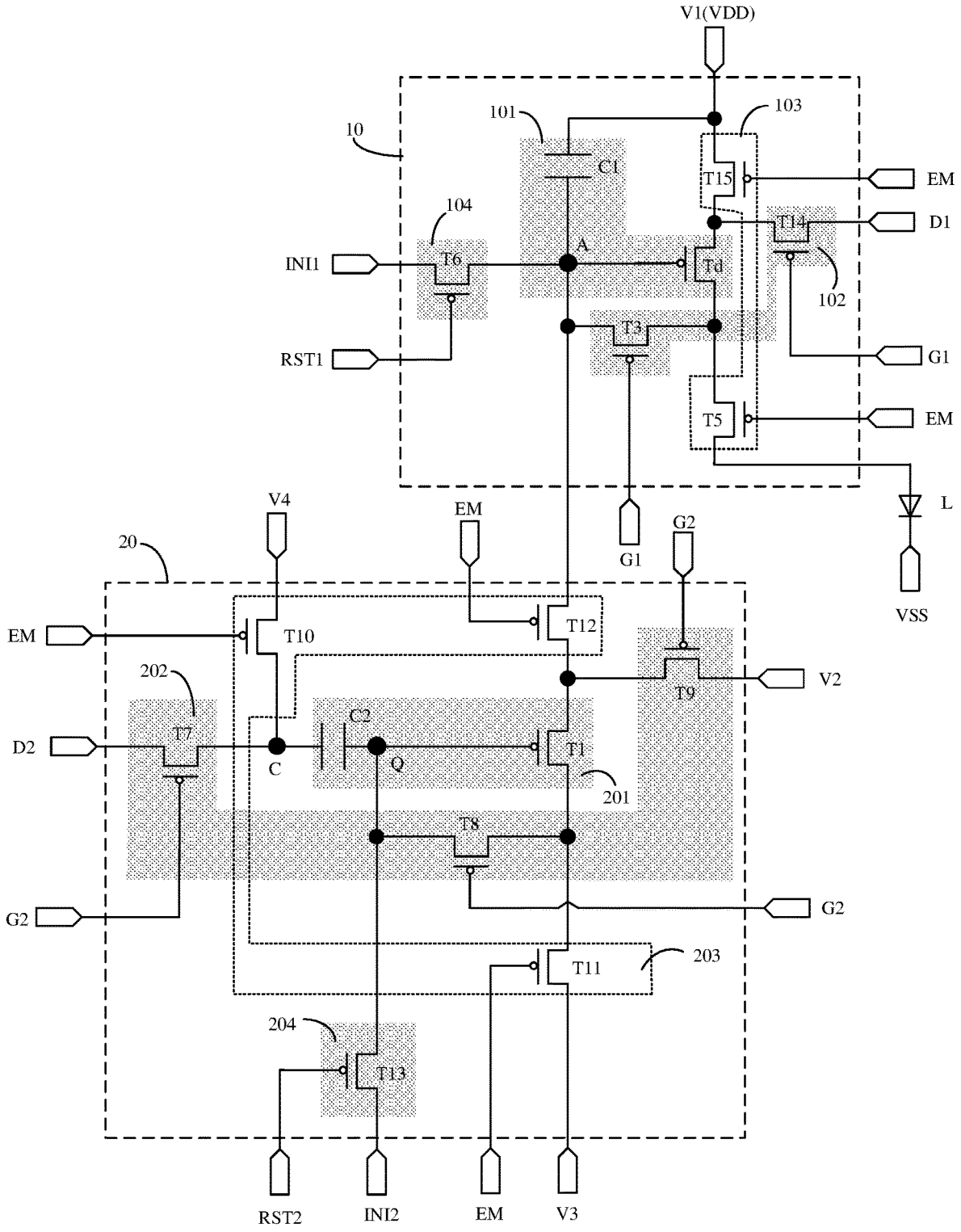
FIG. 12 is a circuit diagram of yet another pixel driving circuit, in accordance with some embodiments.

In some other embodiments, the driving control sub-circuit 10 is connected to the first scan signal terminal G1, the first data signal terminal D1, the first voltage signal terminal V1, the enable signal terminal EM, and the element L to be driven. The first voltage signal terminal V1 is a first power voltage signal terminal VDD. As shown in FIG. 12, the driving control sub-circuit 10 includes the first driving sub-circuit 101, the first data writing sub-circuit 102, the first control sub-circuit 103, and the first reset sub-circuit 104.

The first driving sub-circuit 101 includes the driving transistor Td and the first capacitor C1. The first electrode of the first capacitor C1 is connected to the first node A, and the second electrode of the first capacitor C1 is connected to the first power voltage signal terminal VDD. The gate of the driving transistor Td is connected to the first node A, and the first electrode of the driving transistor Td is connected to the first power voltage signal terminal VDD.

The first data writing sub-circuit 102 includes the third transistor T3 and a fourteenth transistor T14. The gate of the third transistor T3 is connected to the first scan signal terminal G1, the first electrode of the third transistor T3 is connected to the second electrode of the driving transistor Td, and the second electrode of the third transistor T3 is connected to the first node A. A gate of the fourteenth transistor T14 is connected to the first scan signal terminal G1, a first electrode of the fourteenth transistor T14 is connected to the first data signal terminal D1, and a second electrode of the fourteenth transistor T14 is connected to the first electrode of the driving transistor Td.

The first control sub-circuit 103 includes the fifth transistor T5 and a fifteenth transistor T15. The gate of the fifth transistor T5 is connected to the enable signal terminal EM, the first electrode of the fifth transistor T5 is connected to the second electrode of the driving transistor Td, and the second electrode of the fifth transistor T5 is connected to the element L to be driven. A gate of the fifteenth transistor T15 is connected to the enable signal terminal EM, a first electrode of the fifteenth transistor T15 is connected to the first power voltage signal terminal VDD, and a second electrode of the fifteenth transistor T15 is connected to the first electrode of the driving transistor Td.

The first reset sub-circuit 104 includes the sixth transistor T6. The gate of the sixth transistor T6 is connected to the first reset signal terminal RST1, the first electrode of the sixth transistor T6 is connected to the first initial signal terminal INI1, and the second electrode of the sixth transistor T6 is connected to the first node A.

The driving process of the pixel driving circuit shown in FIG. 12 is described below by taking an example where all transistors in the pixel driving circuit shown in FIG. 12 are P-type transistors.

Referring to FIGS. 9 and 12, in the second phase (P2 to P3), the third transistor T3 and the fourteenth transistor T14 are turned on in response to the first scan signal from the first scan signal terminal G1. The first data signal from the first data signal terminal D1 is transmitted to the first electrode of the driving transistor Td through the fourteenth transistor T14 that is turned on, so that the voltage of the first electrode of the driving transistor Td becomes the voltage $V_{data1}$ of the first data signal.

The third transistor T3 is turned on, so that the gate and the second electrode of the driving transistor Td are short connected. In this way, the driving transistor Td is in a saturated state. The voltage of the gate of the driving transistor Td is the sum of the voltage of the first electrode of the driving transistor Td and the threshold voltage thereof, i.e., $V_{data1}+V_{thd}$. Since the gate of the driving transistor Td is connected to the first node A, the voltage of the first node A is equal to the voltage of the gate of the driving transistor Td. In addition, since the first electrode of the first capacitor C1 is connected to the first node A, the voltage of the first electrode of the first capacitor C1 is equal to the voltage of the first node A, i.e., $V_{data1}+V_{thd}$.

Since the second electrode of the first capacitor C1 is connected to the first power voltage signal terminal VDD, the voltage of the second electrode of the first capacitor C1 is the voltage $V_{dd}$ of the first power voltage signal from the first power voltage signal terminal VDD. Therefore, the two electrodes of the capacitor C1 are charged separately, and there is a voltage difference $V_{dd}-V_{data1}-V_{thd}$ between the two electrodes of the first capacitor C1.

In the operating phase, the fifth transistor T5 and the fifteenth transistor T15 are turned on in response to the enable signal from the enable signal terminal EM. The first power voltage signal from the first power voltage signal terminal VDD is transmitted to the first electrode of the driving transistor Td, so that the voltage of the first electrode of the driving transistor Td is the voltage $V_{dd}$ of the first power voltage signal. In this way, the gate-source voltage $V_{gs}$ of the driving transistor Td satisfies that: $V_{gs}=V_{data1}+V_{thd}-V_{dd}$. Therefore, the driving current I flowing through the driving transistor Td satisfies that: $I=K\times(V_{data1}-V_{dd})^2$. Therefore, it may also be possible to compensate for the threshold voltage of the driving transistor Td, and eliminate the influence of the threshold voltage of the driving transistor Td on the driving current. Moreover, the voltage $V_{data1}$ of the first data signal provided by the first data signal terminal D1 may also be controlled to control the amplitude of the driving current flowing through the element L to be driven, so as to achieve display of different gray scales.

It will be noted that, the driving process of the first reset sub-circuit 104 and the time control sub-circuit 20 in the pixel driving circuit shown in FIG. 12 is the same as the driving process of the first reset sub-circuit 104 and the time control sub-circuit 20 in any one of the above embodiments, and both have the same beneficial effects. Details will not be repeated here.

Some embodiments of the present disclosure provide a driving method for the pixel driving circuit. As shown in FIG. 9, a frame period includes a scanning phase (P1 to P6) and an operating phase (P6 to P7). The scanning phase (P1 to P6) includes a plurality of row scanning phases (ts1 to tsN). Each row scanning phase includes steps 10 to 20 (S10 to S20), and the operating phase includes steps 30 to 40 (S30 to S40).

Referring to FIGS. 3 and 9, the driving method is as follows.

S10, writing, by the driving control sub-circuit 10, at least the first data signal from the first data signal terminal D1 into the first driving sub-circuit 101, in response to the first scan signal received from the first scan signal terminal G1.

S20, writing, by the time control sub-circuit 20, the second data signal from the second data signal terminal D2 and the second voltage signal from the second voltage signal terminal V2 into the second driving sub-circuit 201, in response to the second scan signal received from the second scan signal terminal G2.

S30, enabling, by the driving control sub-circuit 10, the first driving sub-circuit 101 to output the driving signal according to the first data signal from the first data signal terminal D1 and the first voltage signal from the first voltage signal terminal V1, in response to the enable signal received from the enable signal terminal EM, so as to drive the element L to be driven to operate.

S40, writing, by the time control sub-circuit 20, the fourth voltage signal that varies within the set voltage range from the fourth voltage signal terminal V4 into the second driving sub-circuit 201, and connecting, by the time control sub-circuit 20, the second driving sub-circuit 201 to the third voltage signal terminal V3 and the first driving sub-circuit 101, in response to the enable signal received from the enable signal terminal EM; and outputting, by the second driving sub-circuit 201, the third voltage signal from the third voltage signal terminal V3 to the first driving sub-circuit 101, in response to the varies in the voltages of the second voltage signal from the second voltage signal terminal V2, the second data signal from the second data signal terminal D2, and the fourth voltage signal from the fourth voltage signal terminal V4, so as to enable the first driving sub-circuit 101 to stop outputting the driving signal to control the operating duration of the element L to be driven.

In some embodiments, as shown in FIG. 4, the first driving sub-circuit 101 includes the driving transistor Td; and the driving control sub-circuit 10 is further connected to the first power voltage signal terminal VDD.

Referring to FIGS. 4 and 9, S10 further includes: writing, by the driving control sub-circuit 10, the first power voltage signal from the first power voltage terminal VDD into the first driving sub-circuit 101, and compensating, by the driving control sub-circuit 10, for the threshold voltage of the driving transistor Td, in response to the first scan signal received from the first scan signal terminal G1.

S30 further includes: writing, by the driving control sub-circuit 10, the first voltage signal from the first voltage signal terminal V1 into the first driving sub-circuit 101, in response to the enable signal received from the enable signal terminal EM.

In some embodiments, as shown in FIGS. 5 to 8, the driving control sub-circuit 10 includes the first driving sub-circuit 101, the first data writing sub-circuit 102 and the first control sub-circuit 103.

Referring to FIGS. 5 to 9, S10 includes step 101 (S101), and S30 includes step 301 (S301).

S101, writing, by the first data writing sub-circuit 102, the first data signal from the first data signal terminal D1 into the second node B, and writing, by the first data writing sub-circuit 102, the first power voltage signal from the first power voltage signal terminal VDD and the threshold voltage of the driving transistor Td into the first node A to compensate for the threshold voltage of the driving transistor Td, in response to the first scan signal received from the first scan signal terminal G1.

S301, writing, by the first control sub-circuit 103, the first voltage signal from the first voltage signal terminal V1 into the second node B, and connecting, by the first control sub-circuit 103, the driving transistor Td to the element L to be driven, in response to the enable signal received from the enable signal terminal EM; and outputting, by the driving transistor Td, the driving signal according to the first data signal and the first voltage signal.

In some embodiments, as shown in FIGS. 5 to 8, the time control sub-circuit 20 includes the second data writing sub-circuit 202, the second control sub-circuit 203, and the second driving sub-circuit 201. S20 includes step 201 (S201), and S40 includes step 401 (S401).

S201, writing, by the second data writing sub-circuit 202, the second data signal from the second data signal terminal D2 into the third node C, and writing, by the second data writing sub-circuit 202, the second voltage signal from the second voltage signal terminal V2 and the threshold voltage of the first transistor T1 into the fourth node Q, in response to the second scan signal received from the second scan signal terminal G2.

S401, transmitting, by the second control sub-circuit 203, the fourth voltage signal from the fourth voltage signal terminal V4 to the third node C, and connecting, by the second control sub-circuit 203, the first transistor T1 to the third voltage signal terminal V3 and the first driving sub-circuit 101 (i.e., the gate of the driving transistor Td in the first driving sub-circuit 101), in response to the enable signal received from the enable signal terminal EM; and outputting, by the second driving sub-circuit 201, the third voltage signal from the third voltage signal terminal V3 to the first driving sub-circuit 101, in response to the second voltage signal, the second data signal, and the variation in the voltage of the fourth voltage signal, so as to enable the first driving sub-circuit 101 to stop outputting the driving signal to control the operating duration of the element L to be driven.

The driving method for the pixel driving circuit has same beneficial effects as the pixel driving circuit described above, and details will not be repeated here.

In some embodiments, as shown in FIGS. 7, 8, 11 and 12, the driving control sub-circuit 10 further includes the first reset sub-circuit 104. In each of the plurality of row scanning phases, referring to FIGS. 7, 8, 11, and 12, S10 further includes step 102 (S102).

S102, transmitting, by the first reset sub-circuit 104, the first initial signal from the first initial signal terminal INI1 to the first node A to reset the first node A, in response to the first reset signal received from the first reset signal terminal RST1.

For example, as shown in FIGS. 8, 11 and 12, the first reset sub-circuit 104 includes the sixth transistor T6. The sixth transistor T6 of the first reset sub-circuit 104 is turned on and transmits the first initial signal from the first initial signal terminal INI1 to the first node A to reset the first node A, in response to the first reset signal from the first reset signal terminal RST1. In this case, the voltage of the first node A is the voltage of the first initial signal. In this case, the first electrode of the first capacitor C1 and the gate of the driving transistor Td, which are both connected to the first node A, are also reset.

In some embodiments, as shown in FIGS. 7, 8, 11 and 12, the time control sub-circuit 20 further includes the second reset sub-circuit 204. In each of the plurality of row scanning phases, referring to FIGS. 7, 8, 11, and 12, S20 further includes step 202 (S202).

S202, transmitting, by the second reset sub-circuit 204, the second initial signal from the second initial signal terminal INI2 to the fourth node Q to reset the fourth node Q, in response to the second reset signal from the second reset signal terminal RST2.

For example, as shown in FIGS. 8, 11, and 12, the second reset sub-circuit 204 includes the thirteenth transistor T13. The thirteenth transistor T13 of the second reset sub-circuit 204 is turned on and transmits the second initial signal from the second initial signal terminal INI2 to the fourth node Q to reset the fourth node Q, in response to the second reset signal from the second reset signal terminal RST2. In this case, the voltage of the fourth node Q is the voltage of the second initial signal. In this case, the second electrode of the second capacitor C2 and the gate of the first transistor T1, which are both connected to the fourth node Q, are also reset.

In each row scanning phase, by using the first reset sub-circuit 104 to reset the voltage of the first driving sub-circuit 101, and using the second reset sub-circuit 204 to reset the voltage of the second driving sub-circuit 201, it may be possible to achieve the noise reduction of the first driving sub-circuit 101 and the second driving sub-circuit 201, and thus avoid an influence on the first data signal and the second data signal that are to be written in the subsequent driving process.

On this basis, in some embodiments, referring to FIG. 1, the display panel 100 further includes: a plurality of first scan signal lines GL1(1) to GL1(N), a plurality of first data signal lines DL1(1) to DL1 (M), a plurality of second scan signal lines GL2(1) to GL2(N), a plurality of second data signal lines DL2(1) to DL2(M), a plurality of enable signal lines E(1) to E(N), a plurality of first voltage signal lines $L_{V1}$, a plurality of second voltage signal lines $L_{V2}$, a plurality of third voltage signal lines $L_{V3}$, and a plurality of fourth voltage signal lines $L_{V4}$. The first scan signal line is configured to provide the first scan signal to the pixel driving circuit. The second scan signal line is configured to provide the second scan signal to the pixel driving circuit. The enable signal line is configured to provide the enable signal to the pixel driving circuit. The first data signal line is configured to provide the first data signal to the pixel driving circuit. The second data signal line is configured to provide the second data signal to the pixel driving circuit. The first voltage signal line is configured to provide the first voltage signal to the pixel driving circuit. The second voltage signal line is configured to provide the second voltage signal to the pixel driving circuit. The third voltage signal line is configured to provide the third voltage signal to the pixel driving circuit. The fourth voltage signal line is configured to provide the fourth voltage signal to the pixel driving circuit. In some examples, pixel driving circuits in a same row of sub-pixel regions P are connected to a same first scan signal line in the plurality of first scan signal lines GL1(1) to GL1(N), a same second scan signal line in the plurality of second scan signal lines GL2(1) to GL2(N), and a same enable signal line in the plurality of enable signal lines E(1) to E(N). Pixel driving circuits in a same column of sub-pixel regions P are connected to a same first data signal line in the plurality of first data signal lines DL1(1) to DL1(M), a same second data signal line in the plurality of second data signal lines DL2(1) to DL2(M), a same first voltage signal line in the plurality of first voltage signal lines $L_{V1}$, a same second voltage signal line in the plurality of second voltage signal lines $L_{V2}$, a same third voltage signal line in the plurality of third voltage signal lines $L_{V3}$, and a same fourth voltage signal line in the plurality of fourth voltage signal lines $L_{V4}$.

For example, as shown in FIG. 1, pixel driving circuits in a first row of sub-pixel regions P are connected to a first scan signal line GL1(1), a second scan signal line GL2(1), and an enable signal line E(1). Pixel driving circuits in a second row of sub-pixel regions P are connected to a first scan signal line GL1(2), a second scan signal line GL2(2), and an enable signal line E(2). Pixel driving circuits in an Nth row of sub-pixel regions P are connected to a first scan signal line GL1(N), a second scan signal line GL2(N), and an enable signal line E(N). Pixel driving circuits in a first column of sub-pixel regions P are connected to a first data signal line DL1(1), a second data signal line DL2(1), a first voltage signal line $L_{V1}$, a second voltage signal line $L_{V2}$, a third voltage signal line $L_{V3}$ and a fourth voltage signal line $L_{V4}$. Pixel driving circuits in a second column of sub-pixel regions P are connected to a first data signal line DL1(2), a second data signal line DL2(2), the first voltage signal line $L_{V1}$, a second voltage signal line $L_{V2}$, a third voltage signal line $L_{V3}$ and a fourth voltage signal line $L_{V4}$. Pixel driving circuits in an Mth column of sub-pixel regions P are connected to a first data signal line DL1 (M), a second data signal line DL2 (M), a first voltage signal line $L_{V1}$, a second voltage signal line $L_{V2}$, a third voltage signal line $L_{V3}$ and a fourth voltage signal line $L_{V4}$.

The first scan signal terminal G1 may be understood as an equivalent connection point after the first scan signal line is connected to the pixel driving circuit. The same is true for the second scan signal terminal G2. The first data signal terminal D1 may be understood as an equivalent connection point after the first data signal line is connected to the pixel driving circuit. The same is true for the second data signal terminal D2. The enable signal terminal EM may be understood as an equivalent connection point after the enable signal line is connected to the pixel driving circuit. The first voltage signal terminal V1 may be understood as an equivalent connection point after the first voltage signal line $L_{V1}$ is connected to the pixel driving circuit. The second voltage signal terminal V2 may be understood as an equivalent connection point after the second voltage signal line $L_{V2}$ is connected to the pixel driving circuit. The third voltage signal terminal V3 may be understood as an equivalent connection point after the third voltage signal line $L_{V3}$ is connected to the pixel driving circuit. The fourth voltage signal terminal V4 may be understood as an equivalent connection point after the fourth voltage signal line $L_{V4}$ is connected to the pixel driving circuit.

It will be noted that, those skilled in the art may determine the connection manner in which the pixel driving circuits in the sub-pixel regions P are connected to the first voltage signal lines $L_{V1}$, the second voltage signal lines $L_{V2}$, the third voltage signal lines $L_{V3}$, and the fourth voltage signal lines $L_{V4}$ according to a spatial structure of the display panel. FIG. 1 illustrates an example where pixel driving circuits in any two columns of sub-pixel regions P are connected to different first voltage signal lines $L_{V1}$, different second voltage signal lines $L_{V2}$, different third voltage signal lines $L_{V3}$, and different fourth voltage signal lines $L_{V4}$. However, the embodiments of the present disclosure are not limited thereto, and it may also be that pixel driving circuits in a plurality of columns (e.g., 2 columns, 3 columns or 4 columns) of sub-pixel regions P are connected to a same first voltage signal line $L_{V1}$, a same second voltage signal line $L_{V2}$, a same third voltage signal line $L_{V3}$, and a same fourth voltage signal line $L_{V4}$.

In some embodiments, as shown in FIG. 1, the display panel 100 further includes a plurality of first power voltage signal lines $L_{VDD}$. The first power voltage signal line $L_{VDD}$ is configured to provide the first power voltage signal to the pixel driving circuit. In some examples, pixel driving circuits in a same column of sub-pixel regions P is connected to a same first power voltage signal line $L_{VDD}$ in the plurality of first power voltage signal lines $L_{VDD}$. Herein, FIG. 1 illustrates an example where pixel driving circuits in any two columns of sub-pixel regions P are connected to different first power voltage signal lines $L_{VDD}$. However, the embodiments of the present disclosure are not limited thereto, and it may also be that pixel driving circuits in a plurality of columns (e.g., 4 columns) of sub-pixel regions P are connected to a same first power voltage signal line $L_{VDD}$. The first power voltage signal terminal VDD may be understood as an equivalent connection point after the first power voltage signal line $L_{VDD}$ is connected to the pixel driving circuit.

In some embodiments, the display panel further includes a plurality of second power voltage signal lines (not shown in FIG. 1). In some examples, elements L to be driven in a same column of sub-pixel regions P are connected to a same second power voltage signal line in the plurality of second power voltage signal lines.

Herein, the second power voltage signal terminal VSS may be understood as an equivalent connection point after the second power voltage signal line is connected to the element L to be driven.

In some embodiments, as shown in FIG. 1, the display panel 100 further includes a plurality of first reset signal lines R1(1) to R1(N) and a plurality of first initial signal lines (not shown in FIG. 1). The first reset signal line is configured to provide the first reset signal to the pixel driving circuit. The first initial signal line is configured to provide the first initial signal to the pixel driving circuit.

In some examples, the pixel driving circuits in the same row of sub-pixel regions P are connected to a same first reset signal line in the plurality of first reset signal lines R1(1) to R1(N), and the pixel driving circuits in the same column of sub-pixel regions P are connected to a same first initial signal line in the plurality of first initial signal lines.

For example, as shown in FIG. 1, the pixel driving circuits in the first row of sub-pixel regions P are connected to a first reset signal line R1(1); the pixel driving circuits located in the second row of sub-pixel regions P are connected to a first reset signal line R1 (2); and the pixel driving circuits located in the Nth row of sub-pixel regions P are connected to a first reset signal line R1 (N).

The first reset signal terminal RST1 may be understood as an equivalent connection point after the first reset signal line is connected to the pixel driving circuit. The first initial signal terminal INI1 may be understood as an equivalent connection point after the first initial signal line is connected to the pixel driving circuit.

In some embodiments, as shown in FIG. 1, the display panel 100 further includes a plurality of second reset signal lines R2(1) to R2(N) and a plurality of second initial signal lines (not shown in FIG. 1). The second reset signal line is configured to provide the second reset signal to the pixel driving circuit. The second initial signal line is configured to provide the second initial signal to the pixel driving circuit.

In some examples, the pixel driving circuits in the same row of sub-pixel regions P are connected to a same second reset signal line in the plurality of second reset signal lines R2(1) to R2(N), and the pixel driving circuits in the same column of sub-pixel regions P are connected to a same second initial signal line in the plurality of second initial signal lines.

For example, as shown in FIG. 1, the pixel driving circuits in the first row of sub-pixel regions P are connected to a second reset signal line R2(1); the pixel driving circuits in the second row of sub-pixel regions P are connected to a second reset signal line R2(2); and the pixel driving circuits in the Nth row of sub-pixel regions are connected to a second reset signal line R2(N).

The second reset signal terminal RST2 may be understood as an equivalent connection point after the second reset signal line is connected to the pixel driving circuit. The second initial signal terminal INI2 may be understood as an equivalent connection point after the second initial signal line is connected to the pixel driving circuit.

It will be noted that, arrangements of the plurality of signal lines included in the display panel described in the above embodiments and the wiring diagram of the display panel shown in FIG. 1 are only some examples, and the embodiments of the present disclosure are not limited thereto.

The foregoing descriptions are merely specific implementation manners of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. A pixel driving circuit, comprising:

a driving control sub-circuit, connected to at least a first scan signal terminal, a first data signal terminal, a first voltage signal terminal, and an enable signal terminal; wherein the driving control sub-circuit includes a first driving sub-circuit; the driving control sub-circuit is configured to: be connected to an element to be driven; write at least a first data signal from the first data signal terminal into the first driving sub-circuit, in response to a first scan signal received from the first scan signal terminal; and enable the first driving sub-circuit to output a driving signal according to the first data signal and a first voltage signal from the first voltage signal terminal, in response to an enable signal received from the enable signal terminal, so as to drive the element to be driven to operate; and a time control sub-circuit, connected to at least a second voltage signal terminal, a third voltage signal terminal, a fourth voltage signal terminal, a second scan signal terminal, a second data signal terminal, the enable signal terminal, and the first driving sub-circuit; wherein the time control sub-circuit includes a second driving sub-circuit; the time control sub-circuit is configured to: write a second voltage signal from the second voltage signal terminal and a second data signal from the second data signal terminal into the second driving sub-circuit, in response to a second scan signal received from the second scan signal terminal; and write a fourth voltage signal that varies within a set voltage range from the fourth voltage signal terminal into the second driving sub-circuit, and connect the second driving sub-circuit to the third voltage signal terminal and the first driving sub-circuit, in response to the enable signal received from the enable signal terminal; and the second driving sub-circuit is configured to output a third voltage signal from the third voltage signal terminal to the first driving sub-circuit, in response to the second voltage signal, the second data signal, and a variation in a voltage of the fourth voltage signal, so as to enable the first driving sub-circuit to stop outputting the driving signal to control an operating duration of the element to be driven.

2. The pixel driving circuit according to claim 1, wherein the first driving sub-circuit includes a driving transistor;

the driving control sub-circuit is further connected to a first power voltage signal terminal; and the driving control sub-circuit is further configured to: write a first power voltage signal from the first power voltage terminal into the first driving sub-circuit, and compensate for a threshold voltage of the driving transistor, in response to the first scan signal received from the first scan signal terminal; and write the first voltage signal into the first driving sub-circuit, in response to the enable signal received from the enable signal terminal, so that the driving signal is independent of the first power voltage signal and the threshold voltage of the driving transistor.

3. The pixel driving circuit according to claim 2, wherein the driving control sub-circuit further includes a first data writing sub-circuit and a first control sub-circuit; the first driving sub-circuit further includes a first capacitor; a first electrode of the first capacitor is connected to a first node, and a second electrode of the first capacitor is connected to a second node; a gate of the driving transistor is connected to the first node, and a first electrode of the driving transistor is connected to the first power voltage signal terminal; wherein the first data writing sub-circuit is connected to the first scan signal terminal, the first data signal terminal, a second electrode of the driving transistor, the first node, and the second node; the first data writing sub-circuit is configured to: write the first data signal into the second node, write the first power voltage signal into the first node, and compensate for the threshold voltage of the driving transistor, in response to the received first scan signal; and the first control sub-circuit is connected to the enable signal terminal, the first voltage signal terminal, the second node, and the second electrode of the driving transistor; and the first control sub-circuit is configured to: be connected to the element to be driven; and write the first voltage signal into the second node, and connect the driving transistor to the element to be driven, in response to the received enable signal.

4. The pixel driving circuit according to claim 3, wherein the first data writing sub-circuit includes a second transistor and a third transistor; wherein a gate of the second transistor is connected to the first scan signal terminal, a first electrode of the second transistor is connected to the first data signal terminal, and a second electrode of the second transistor is connected to the second node; and a gate of the third transistor is connected to the first scan signal terminal, a first electrode of the third transistor is connected to the second electrode of the driving transistor, and a second electrode of the third transistor is connected to the first node.

5. The pixel driving circuit according to claim 3, wherein the first control sub-circuit includes a fourth transistor and a fifth transistor; wherein a gate of the fourth transistor is connected to the enable signal terminal, a first electrode of the fourth transistor is connected to the first voltage signal terminal, and a second electrode of the fourth transistor is connected to the second node; and a gate of the fifth transistor is connected to the enable signal terminal, a first electrode of the fifth transistor is connected to the second electrode of the driving transistor, and a second electrode of the fifth transistor is configured to be connected to the element to be driven.

6. The pixel driving circuit according to claim 1, wherein the driving control sub-circuit further includes a first reset sub-circuit; wherein the first reset sub-circuit is connected to a first initial signal terminal, a first reset signal terminal and the first node; the first reset sub-circuit is configured to transmit a first initial signal from the first initial signal terminal to the first node to reset the first node, in response to a first reset signal received from the first reset signal terminal.

7. The pixel driving circuit according to claim 6, wherein the first reset sub-circuit includes a sixth transistor; wherein a gate of the sixth transistor is connected to the first reset signal terminal, a first electrode of the sixth transistor is connected to the first initial signal terminal, and a second electrode of the sixth transistor is connected to the first node.

8. The pixel driving circuit according to claim 1, wherein the time control sub-circuit further includes a second data writing sub-circuit and a second control sub-circuit; the second driving sub-circuit includes a first transistor and a second capacitor; a first electrode of the second capacitor is connected to a third node, and a second electrode of the second capacitor is connected to a fourth node; and a gate of the first transistor is connected to the fourth node; wherein the second data writing sub-circuit is connected to the second scan signal terminal, the second data signal terminal, the second voltage signal terminal, the third node, the fourth node, and the first transistor; the second data writing sub-circuit is configured to: write the second data signal into the third node, write the second voltage signal into the fourth node, and compensate for a threshold voltage of the first transistor, in response to the received second scan signal; and the second control sub-circuit is connected to the enable signal terminal, the third voltage signal terminal, the fourth voltage signal terminal, the third node, the first transistor, and the first driving sub-circuit; the second control sub-circuit is configured to: write the fourth voltage signal into the third node, and connect the first transistor to the first driving sub-circuit and the third voltage signal terminal, in response to the received enable signal.

9. The pixel driving circuit according to claim 8, wherein the second data writing sub-circuit includes a seventh transistor, an eighth transistor, and a ninth transistor; wherein a gate of the seventh transistor is connected to the second scan signal terminal, a first electrode of the seventh transistor is connected to the second data signal terminal, and a second electrode of the seventh transistor is connected to the third node;

a gate of the eighth transistor is connected to the second scan signal terminal, a first electrode of the eighth transistor is connected to a first electrode of the first transistor, and a second electrode of the eighth transistor is connected to the fourth node; and a gate of the ninth transistor is connected to the second scan signal terminal, a first electrode of the ninth transistor is connected to the second voltage signal terminal, and a second electrode of the ninth transistor is connected to a second electrode of the first transistor.

10. The pixel driving circuit according to claim 8, wherein the second control sub-circuit includes a tenth transistor, an eleventh transistor, and a twelfth transistor; wherein a gate of the tenth transistor is connected to the enable signal terminal, a first electrode of the tenth transistor is connected to the fourth voltage signal terminal, and a second electrode of the tenth transistor is connected to the third node;

a gate of the eleventh transistor is connected to the enable signal terminal, a first electrode of the eleventh transistor is connected to the third voltage signal terminal, and a second electrode of the eleventh transistor is connected to a second electrode of the first transistor; and a gate of the twelfth transistor is connected to the enable signal terminal, a first electrode of the twelfth transistor is connected to a first electrode of the first transistor, and a second electrode of the twelfth transistor is connected to a gate of a driving transistor in the first driving sub-circuit.

11. The pixel driving circuit according to claim 8, wherein the time control sub-circuit further includes a second reset sub-circuit; wherein the second reset sub-circuit is connected to a second initial signal terminal, a second reset signal terminal and the fourth node; the second reset sub-circuit is configured to transmit a second initial signal from the second initial signal terminal to the fourth node to reset the fourth node, in response to a second reset signal received from the second reset signal terminal.

12. The pixel driving circuit according to claim 11, wherein the second reset sub-circuit includes a thirteenth transistor; wherein a gate of the thirteenth transistor is connected to the second reset signal terminal, a first electrode of the thirteenth transistor is connected to the second initial signal terminal, and a second electrode of the thirteenth transistor is connected to the fourth node.

13. A display panel, comprising:

a plurality of pixel driving circuits according to claim 1; and a plurality of elements to be driven, an element to be driven of the plurality of elements to be driven being connected to a corresponding pixel driving circuit.

14. The display panel according to claim 13, wherein the display panel has a plurality of sub-pixel regions, and each pixel driving circuit is disposed in a sub-pixel region; the display panel further comprises:

a plurality of first scan signal lines, first scan signal terminals connected to pixel driving circuits in a same row of sub-pixel regions being connected to a corresponding first scan signal line;

a plurality of second scan signal lines, second scan signal terminals connected to the pixel driving circuits in the same row of sub-pixel regions being connected to a corresponding second scan signal line;

a plurality of first data signal lines, first data signal terminals connected to pixel driving circuits in a same column of sub-pixel regions being connected to a corresponding first data signal line; and a plurality of second data signal lines, second data signal terminals connected to the pixel driving circuits in the same column of sub-pixel regions being connected to a corresponding second data signal line.

15. The display panel according to claim 13, wherein the elements to be driven are current type light-emitting diodes.

16. A display apparatus, comprising the display panel according to claim 13.

17. A driving method for a pixel driving circuit, the pixel driving circuit being according to claim 1, a frame period including a scanning phase and an operating phase, the scanning phase including a plurality of row scanning phases; the driving method comprising:

in each of the plurality of row scanning phases, writing, by the driving control sub-circuit, at least the first data signal from the first data signal terminal into the first driving sub-circuit, in response to the first scan signal received from the first scan signal terminal; and writing, by the time control sub-circuit, the second data signal from the second data signal terminal and the second voltage signal from the second voltage signal terminal into the second driving sub-circuit, in response to the second scan signal received from the second scan signal terminal; and in the operating phase, enabling, by the driving control sub-circuit, the first driving sub-circuit to output the driving signal according to the first data signal and the first voltage signal from the first voltage signal terminal, in response to the enable signal received from the enable signal terminal, so as to drive the element to be driven to operate;

writing, by the time control sub-circuit, the fourth voltage signal that varies within the set voltage range from the fourth voltage signal terminal into the second driving sub-circuit, and connecting, by the time control sub-circuit, the second driving sub-circuit to the third voltage signal terminal and the first driving sub-circuit, in response to the enable signal received from the enable signal terminal; and outputting, by the second driving sub-circuit, the third voltage signal from the third voltage signal terminal to the first driving sub-circuit, in response to the second voltage signal, the second data signal, and the variation in the voltage of the fourth voltage signal, so as to enable the first driving sub-circuit to stop outputting the driving signal to control the operating duration of the element to be driven.

18. The driving method according to claim 17, wherein the first driving sub-circuit includes a driving transistor, and the driving control sub-circuit is further connected to a first power voltage signal terminal; the driving method further comprises:

in each of the plurality of row scanning phases, writing, by the driving control sub-circuit, a first power voltage signal from the first power voltage signal terminal into the first driving sub-circuit, and compensating, by the driving control sub-circuit, for a threshold voltage of the driving transistor, further in response to the received first scan signal; and in the operating phase, writing, by the driving control sub-circuit, the first voltage signal into the first driving sub-circuit, further in response to the received enable signal.

19. The driving method according to claim 18, wherein the first driving sub-circuit further includes a first capacitor; a first electrode of the first capacitor is connected to a first node, and a second electrode of the first capacitor is connected to a second node; a gate of the driving transistor is connected to the first node, and a first electrode of the driving transistor is connected to the first power voltage signal terminal; the driving control sub-circuit further includes a first data writing sub-circuit and a first control sub-circuit; the first data writing sub-circuit is connected to the first scan signal terminal, the first data signal terminal, a second electrode of the driving transistor, the first node, and the second node; the first control sub-circuit is connected to the enable signal terminal, the first voltage signal terminal, the second node, and the second electrode of the driving transistor; and the first control sub-circuit is configured to be connected to the element to be driven;

in each of the plurality of row scanning phases, writing, by the driving control sub-circuit, at least the first data signal from the first data signal terminal into the first driving sub-circuit, in response to the first scan signal received from the first scan signal terminal; and in the operating phase, enabling, by the driving control sub-circuit, the first driving sub-circuit to output the driving signal according to the first data signal and the first voltage signal from the first voltage signal terminal, in response to the enable signal received from the enable signal terminal, so as to drive the element to be driven to operate, includes:

in each of the plurality of row scanning phases, writing, by the first data writing sub-circuit, the first data signal into the second node, writing, by the first data writing sub-circuit, the first power voltage signal into the first node, and compensating, by the first data writing sub-circuit, for the threshold voltage of the driving transistor, in response to the received first scan signal; and in the operating phase, writing, by the first control sub-circuit, the first voltage signal into the second node, and connecting, by the first data writing sub-circuit, the driving transistor to the element to be driven, in response to the received enable signal; and outputting, by the driving transistor, the driving signal according to the first data signal and the first voltage signal.

20. The driving method according to claim 17, wherein the second driving sub-circuit includes a first transistor and a second capacitor; a first electrode of the second capacitor is connected to a third node, and a second electrode of the second capacitor is connected to a fourth node; and a gate of the first transistor is connected to the fourth node; the time control sub-circuit further includes a second data writing sub-circuit and a second control sub-circuit; the second data writing sub-circuit is connected to the second scan signal terminal, the second data signal terminal, the second voltage signal terminal, the third node, the fourth node, and the first transistor; and the second control sub-circuit is connected to the enable signal terminal, the third voltage signal terminal, the fourth voltage signal terminal, the third node, the first transistor, and the first driving sub-circuit;

in each of the plurality of row scanning phases, writing, by the time control sub-circuit, the second data signal from the second data signal terminal and the second voltage signal from the second voltage signal terminal into the second driving sub-circuit, in response to the second scan signal received from the second scan signal terminal; and in the operating phase, writing, by the time control sub-circuit, the fourth voltage signal that varies within the set voltage range from the fourth voltage signal terminal into the second driving sub-circuit, and connecting, by the time control sub-circuit, the second driving sub-circuit to the third voltage signal terminal and the first driving sub-circuit, in response to the enable signal received from the enable signal terminal, includes:

in each of the plurality of row scanning phases, writing, by the second data writing sub-circuit, the second data signal into the third node, writing, by the second data writing sub-circuit, the second voltage signal into the fourth node, and compensating, by the second data writing sub-circuit, for a threshold voltage of the first transistor, in response to the received second scan signal; and in the operating phase, writing, by the second control sub-circuit, the fourth voltage signal into the third node, and connecting, by the second control sub-circuit, the first transistor to the third voltage signal terminal and the first driving sub-circuit, in response to the received enable signal.

* * * * *